US011768006B2

(12) United States Patent
Furman et al.

(10) Patent No.: US 11,768,006 B2
(45) Date of Patent: Sep. 26, 2023

(54) SYSTEM AND APPARATUS FOR CONDITIONING OF INDOOR AIR

(71) Applicant: FT Energy Controls, LLC, Pittsburgh, PA (US)

(72) Inventors: Richard Furman, Atlanta, GA (US); Zachary M. Thomas, Pittsburgh, PA (US)

(73) Assignee: FT Energy Controls, LLC, Pittsburgh, PA (US)

( * ) Notice: Subject to any disclaimer, the term of this patent is extended or adjusted under 35 U.S.C. 154(b) by 0 days.

(21) Appl. No.: 17/961,522

(22) Filed: Oct. 6, 2022

(65) Prior Publication Data

US 2023/0041522 A1 Feb. 9, 2023

Related U.S. Application Data

(63) Continuation of application No. 17/367,586, filed on Jul. 5, 2021, now Pat. No. 11,466,890, which is a (Continued)

(51) Int. Cl.
*F24F 11/00* (2018.01)
*F24F 11/84* (2018.01)
(Continued)

(52) U.S. Cl.
CPC ..... *F24F 11/84* (2018.01); *F24F 11/47* (2018.01); *F24F 2110/10* (2018.01); *F24F 2110/20* (2018.01)

(58) Field of Classification Search
CPC ..... F24F 11/47; F24F 11/84
See application file for complete search history.

(56) References Cited

U.S. PATENT DOCUMENTS 4,516,720 A 5/1985 Chaplin
5,139,549 A 8/1992 Knodel et al.
(Continued)

FOREIGN PATENT DOCUMENTS

CN 201368521 Y 12/2009
CN 203375527 U 1/2014
(Continued)

OTHER PUBLICATIONS

Lawrosa, Do It Yourself How-Tos on Diverter Tees, Oct. 13, 2013, https://www.doityourself.com/forum/boilers-home-heating-steam-hot-water-systems/507662-air-lock.html.
(Continued)

*Primary Examiner* — Mark A Connolly
(74) *Attorney, Agent, or Firm* — Zachary M. Thomas

(57) ABSTRACT

A control system is provided for controlling heating and/or cooling with a conditioning load such as fan coils and chilled beams. Based on user input and ambient conditions, the control system determines a desired temperature for the liquid entering the load and combines fresh supply liquid (e.g., from a chiller or boiler) with a portion of the liquid that has passed through the load, to achieve the target load input temperature for the liquid. A recirculation pump may be used to return a portion of the liquid exiting the load for mixing with the fresh supply liquid and a control valve may be used to adjust the ratio of fresh supply liquid and recirculated liquid to achieve the targeted temperature. The control systems can be compatible with a variety of liquid supply systems such as two- and four-pipe systems.

25 Claims, 14 Drawing Sheets

Related U.S. Application Data continuation of application No. 16/865,260, filed on May 1, 2020, now Pat. No. 11,054,167.

(60) Provisional application No. 62/843,514, filed on May 5, 2019.

(51) Int. Cl.

| | |
|---|---|
| ***F24F 11/47*** | (2018.01) |
| *F24F 110/20* | (2018.01) |
| *F24F 110/10* | (2018.01) |

(56) References Cited

U.S. PATENT DOCUMENTS

| | | | |
|---|---|---|---|
| 8,556,187 | B1 | 10/2013 | Darcy |
| 9,625,222 | B2 | 4/2017 | Fischer |
| 10,649,508 | B1 | 5/2020 | Smith |
| 2004/0188082 | A1 | 9/2004 | Riello |
| 2012/0291468 | A1 | 11/2012 | Kato et al. |
| 2015/0032267 | A1 | 1/2015 | Lindelof et al. |
| 2018/0372345 | A1 | 12/2018 | Fischer et al. |
| 2021/0018206 | A1 | 1/2021 | Barooah |

FOREIGN PATENT DOCUMENTS

| | | | | |
|---|---|---|---|---|
| CN | 204404420 | U | | 6/2015 |
| CN | 105180244 | A | | 12/2015 |
| JP | H09166346 | A | | 6/1997 |
| RU | 2300709 | C2 | * | 6/2007 |
| WO | 2008/072992 | A1 | | 6/2008 |
| WO | 2014/094215 | A1 | | 6/2014 |

OTHER PUBLICATIONS

Weldon, Commercial Inspection Tips: Water Cooling in Buildings, ASHI Reporter, Oct. 2007, http://www.ashireporter.org/HomeInspection/Articles/Commercial-Inspection-Tips-Water-Co.

Britt, 4 Piping Strategies for Active Chilled Beam Systems, Jan. 29, 2016, http://blogs.heattransfersales.com/blog/4-piping-strategies-for-active-chilled-beam-systems.

Bell & Gossett, Bulletin No. TEH 875—Single Coil Instantaneous Room by Room Heating-Cooling Systems, pp. 25-26, 28, 34-35—ITT, 1965.

Taco, LOFlo injection pumping, Taco, Inc., Cranston, RI, http://apps.taco-hvac.com/uploads/FileLibrary/100-85.pdf.

SEMCO. NEUTON Controlled Chilled Beam Pump Module —Technical Guide, 2018, FlaktGroup SEMCO, Columbia, Missouri, http://info.semcohvac.com/tech-neuton.

Aaon, AAONAIRE Energy Recovery, AAON, Inc., Tulsa, OK, R85590-110103 p5. https://www.aaon.com/Documents/Technical/AAONAire_110103.pdf.

Twa Panel Systems, Inc., How Twa MAC Beams Work, Alberta, Canada, 2001, http://www.twapanels.ca/chilledbeamworks.html.

* cited by examiner

SYSTEM AND APPARATUS FOR CONDITIONING OF INDOOR AIR

RELATED APPLICATION

This application is a continuation of U.S. patent application Ser. No. 17/367,586, filed Jul. 5, 2021, which is a continuation of U.S. patent application Ser. No. 16/865,260, filed May 1, 2020, now U.S. Pat. No. 11,054,167, issued Jul. 6, 2021, which itself claims priority under 35 U.S.C. § 119(e) to U.S. provisional patent application, U.S. Ser. No. 62/843,514, filed May 5, 2019, all of which are herein incorporated by reference in their entirety.

TECHNICAL FIELD

The present disclosure relates to the field of conditioning of indoor air. Some aspects of the disclosure relate to control systems for chilled beams.

BACKGROUND

Heating, ventilation, and air conditioning (HVAC) technologies have been developed for conditioning indoor air with the goal of effectively and efficiently providing comfort for occupants and/or satisfactory ambient conditions for property. Chilled beams are a heating and cooling technology that can utilize heated or chilled water to condition indoor air. Water is passed through a finned-tube coil of pipe which exchanges heat with the surrounding air through radiation and convection. A chilled beam may be mounted to the ceiling of a room.

There are two types of chilled beams: passive and active. With passive chilled beams, as the cold water passes through the coil, the coil cools and the air around it becomes denser and moves down toward the floor. This convective heat transfer allows warmer air to rise toward the ceiling to replace the cold air in a continuing cycle. As cold water is pumped through the beam it allows the cycle to continue.

The active chilled beams make use of ventilation air that has been preconditioned by a Dedicated Outdoor Air System (DOAS). Energy Recovery Ventilators (ERVs) are a special type of DOAS, which make use of the energy recovery process by exchanging the energy contained in the exhausted building air and use it to condition the incoming, outdoor air. An ERV is a type of air-to-air heat exchanger that not only transfers sensible heat but also latent heat. Since both temperature and moisture are transferred, ERVs can be considered as total enthalpy exchange devices.

The ERV technology has demonstrated an effective means of reducing energy costs and has allowed for the downsizing of chillers and boilers. Additionally, these systems allow for the indoor environment to maintain a more comfortable humidity level.

Various ERV manufacturers are using enthalpy wheels in combination with desiccant wheels and cooling coils to obtain very low humidity levels. These ERVs are able to provide ventilation air that can provide all of the latent cooling (moisture removal) that is needed for humidity control. If the humidity is controlled, then the cooling coil only needs to do sensible cooling (temperature reduction). If the cooling coil does not condense any moisture, then no condensate is produced, and there is no need for a condensate pan and condensate drainage system. The ventilation air from the ERV can be used in a chilled beam to induce the air flow that is required across the dry, cooling coil. This eliminates the need for a fan. With no fans and no compressors in the rooms, this system is much quieter.

An active beam accepts dry air from the ERV through a supply duct. This supply air is then forced through nozzles in order to create high velocity air streams which reduces the pressure, inducing room air up through the heating/cooling coil. This induced air then mixes with the supply air and is discharged back into the space.

The water temperature supplied to the chilled beams must be a few degrees higher than the air dew point to avoid any condensation on the coil. A typical chiller discharge temperature is between 42 and 45° F. (average 44° F.). To avoid condensation on the coil, the typical entering water temperature to the chilled beams normally needs to be controlled between 56 and 60° F. (average 58° F.).

SUMMARY

Chilled beams are a technology being used as part of HVAC systems throughout the world. Chilled beams typically use cooled and heated water to cool or heat, respectively, a conditioned space. The cold and hot water supplies used to fuel chilled beams are typically shared among a number of conditioning loads that may include fan coils, chilled beams and other devices and these may be divided among several conditioned spaces within an indoor environment. These conditioned spaces may have different heating and cooling needs depending, for example, on the number of people in the space, the facing of the conditioned space relative to uncontrolled sources (e.g., radiant heat from the sun), personal preferences, and the like.

Aspects of the invention relate to a control system that may be used with a single chilled beam, thus allowing each chilled beam to be independently controlled reducing the time it takes to achieve and maintain comfortable conditions in all conditioned spaces serviced by a HVAC system.

When operating in a cooling mode the water input to a chilled beam may be just above the dew point to maximize the rate of cooling while preventing condensation on the chilled beam and the associated need for collection and draining or, if draining is not provided or ineffective, water damage to the facility. As the dew point will depend on the ambient conditions of each chilled beam, the cold water provided by the chiller in an HVAC system generally cannot simultaneously be near the dew point of all chilled beams requiring cooling.

The control system may have a recirculation pump that recirculates a portion of the return water from the chilled beam. During cooling operation, the return water may be warmer than the input water to the chilled beam if the return water has absorbed heat from the conditioned space. The recirculated portion of the return water is combined with water from the cold-water supply in proportions suitable to provide both a desired flow rate and a desired water temperature. In the case of cooling, the pumped portion of the water returned from the chilled beam warms the cold water from the supply. This combined water is provided to the input of the chilled beam.

The control system may include a control valve that restricts flow of the cold-water supply in the control system. The temperature of the combined water (i.e., the water from the supply and the recirculated water) can be monitored to determine whether more or less water from the cold water supply is needed to achieve the desired input water temperature to the chilled beam. The control valve may be opened or closed with variable degree to increase or decrease, respectively, the amount of supply water.

The control system includes a control module to control the recirculation pump and the control valve based on inputs from the user and various sensors. Example inputs used for control include a setpoint temperature for the conditioned space, an actual temperature of the conditioned space, an indication of moisture content in the air, the temperature of liquid entering into the chilled beam, an operating mode for the control system (e.g., heating, cooling).

One aspect relates to a control system for controlling liquid flow from a supply into a chilled beam. The control system comprises a supply input port; a load return port; a recirculation pump for pumping liquid from a pump input port to a pump output port, the pump input port connected to receive a first portion of liquid flowing from the load return port; a junction configured to combine liquid flowing from the pump output port with liquid flowing from the supply input port; a load input port configured to receive such combined liquid from the junction; a supply return port connected to receive a remaining portion of the liquid flowing from the load return port; a control valve to restrict flow of liquid between the supply input port and the supply return port; a sensor; and a control module to control the control valve based at least in part on a measurement from the sensor.

In some embodiments of the control system the control module is configured to receive an ambient temperature in a conditioned space and a setpoint temperature, and to control the control valve based on the setpoint temperature and the ambient temperature. The sensor may be a temperature sensor that measures a load input temperature of the combined liquid, and the control module may be configured to control the control valve based on a target liquid temperature and the load input temperature. The control module may be further configured to receive an indication of moisture content of air in the conditioned space, determine a dew point from the indication of moisture content and the ambient temperature, and determine the target liquid temperature based on the dew point, the setpoint temperature, and the ambient temperature.

In some embodiments of the control system the junction is a second junction and the control system further comprises a first junction to split flow from the load return port into the first portion and the remaining portion; and a check valve connected between the supply return port and the first junction, the check valve oriented to allow liquid to flow through the check valve to the supply return port. The control valve may be connected between the supply input port and the second junction.

In some embodiments of the control system the junction is a second junction and the control system further comprises a first junction to split flow from the load return port into the first portion and the remaining portion; and a check valve connected between the supply input port and the second junction, the check valve oriented to allow liquid to flow from the supply input port through the check valve. The control valve may be connected between the supply return port and the first junction.

In some embodiments of the control system the recirculation pump is a fixed speed pump.

In some embodiments of the control system the supply input port is a first supply input port, the supply return port is a first supply return port, and the control valve is a first control valve, and the control system further comprises a second supply input port; a second supply return port; and a second control valve connected between the second supply return port and the pump input port to restrict flow of liquid between the second supply input port and the second supply return port.

Another aspect relates to a control system for controlling liquid flowing from a supply into a chilled beam, the control system comprising a supply input port; a load return port; a first junction to split flow from the load return port into a first portion and a second portion; a recirculation pump for pumping liquid from a pump input port to a pump output port, the pump input port configured to receive the first portion from the first junction; a supply return port configured to receive the second portion; a second junction to combine flow from the supply input port and the pump output port; a load input port configured to receive such combined flow from the second junction; a control valve to control flow of liquid between the supply input port and the supply return port; a sensor; and a control module to control the control valve based at least in part on a measurement from the sensor.

In some embodiments of the control system the supply input port is a first supply input port, the supply return port is a first supply return port, and the control valve is a first control valve, the system further comprising a second supply input port; a second supply return port; and a second control valve connected between the second supply return port and the first junction to restrict flow of liquid between the second supply input port and the second supply return port. The first control valve may connected between the first supply input port and the second junction, and the control system may further comprise a first check valve connected between the first supply return port and the first junction, the first check valve oriented to allow liquid to flow through the first check valve to the first supply return port; and a second check valve connected between the second supply input port and the second junction, the second check valve oriented to allow liquid to flow from the second supply input port through the second check valve. The sensor may be a liquid temperature sensor positioned to measure a load input temperature of liquid flowing from the second junction to the load input port. The control system may further comprise an ambient temperature sensor and a humidity sensor to measure ambient conditions, wherein the control module is further configured to receive a setpoint temperature; determine a dew point from measurements from the ambient temperature sensor and the humidity sensor, determine a target load input temperature based on the dew point, the load input temperature, and the setpoint temperature, and control the control valve to achieve the target load input temperature at the temperature sensor.

Another aspect relates to a method of controlling flow of a liquid from a liquid supply system into a conditioning load, the method comprising receiving a supply input flow from the liquid supply system at a supply input port; receiving load return flow from the conditioning load at a load return port; dividing the load return flow into a recirculation flow and a supply return flow; pumping the recirculation flow into a junction; discharging the supply return flow to the liquid supply system through a supply return port; forming a load input flow by combining, in the junction, the supply input flow with the recirculation flow; delivering the load input flow to the conditioning load through a load input port; measuring a load input temperature of the liquid of the load input flow; and controlling a control valve to restrict the supply input flow and the supply return flow based at least in part on the load input temperature.

In some embodiments the pumping is performed by a fixed speed pump for pumping only the recirculation flow.

In some embodiments a temperature of the liquid of the supply input flow is less than an ambient temperature of an indoor space conditioned by the conditioning load, and the method further comprises measuring a dew point temperature near the conditioning load; and determining a target load input temperature as the dew point plus a positive margin temperature, wherein the controlling the control valve comprises reducing the control valve's resistance to flow if the load input temperature is higher than the target load input temperature and increasing the control valve's resistance to flow if the load input temperature is less than the target load input temperature.

In some embodiments the method further comprises receiving a setpoint temperature specifying what ambient temperature is desired in an indoor space conditioned by the conditioning load; measuring the ambient temperature in the indoor space; and determining a target load input temperature based at least in part on the setpoint temperature and the ambient temperature, wherein controlling the control valve comprises adjusting the control valve's resistance to flow so as to cause a temperature difference between the target load input temperature and the load input temperature to decrease. The temperature of the liquid of the supply input flow may be less than an ambient temperature of an indoor space conditioned by the conditioning load, and the method may further comprise determining a temperature of the supply input flow, wherein the pumping is started when the target load input temperature is above the temperature of the supply input flow.

Some embodiments relate to a control system that uses only a single control valve and a single, fixed-speed pump to vary the relative amounts of the recirculation flow through the pump and the flow from the liquid supply to achieve a desired temperature for the liquid flowing into a chilled beam. Another embodiment relates to a control system that uses only a single control valve and a single, fixed-speed pump to vary the relative amounts of the recirculation flow through the pump and the flow from the liquid supply to achieve a desired flow rate for the liquid flowing into the chilled beam.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
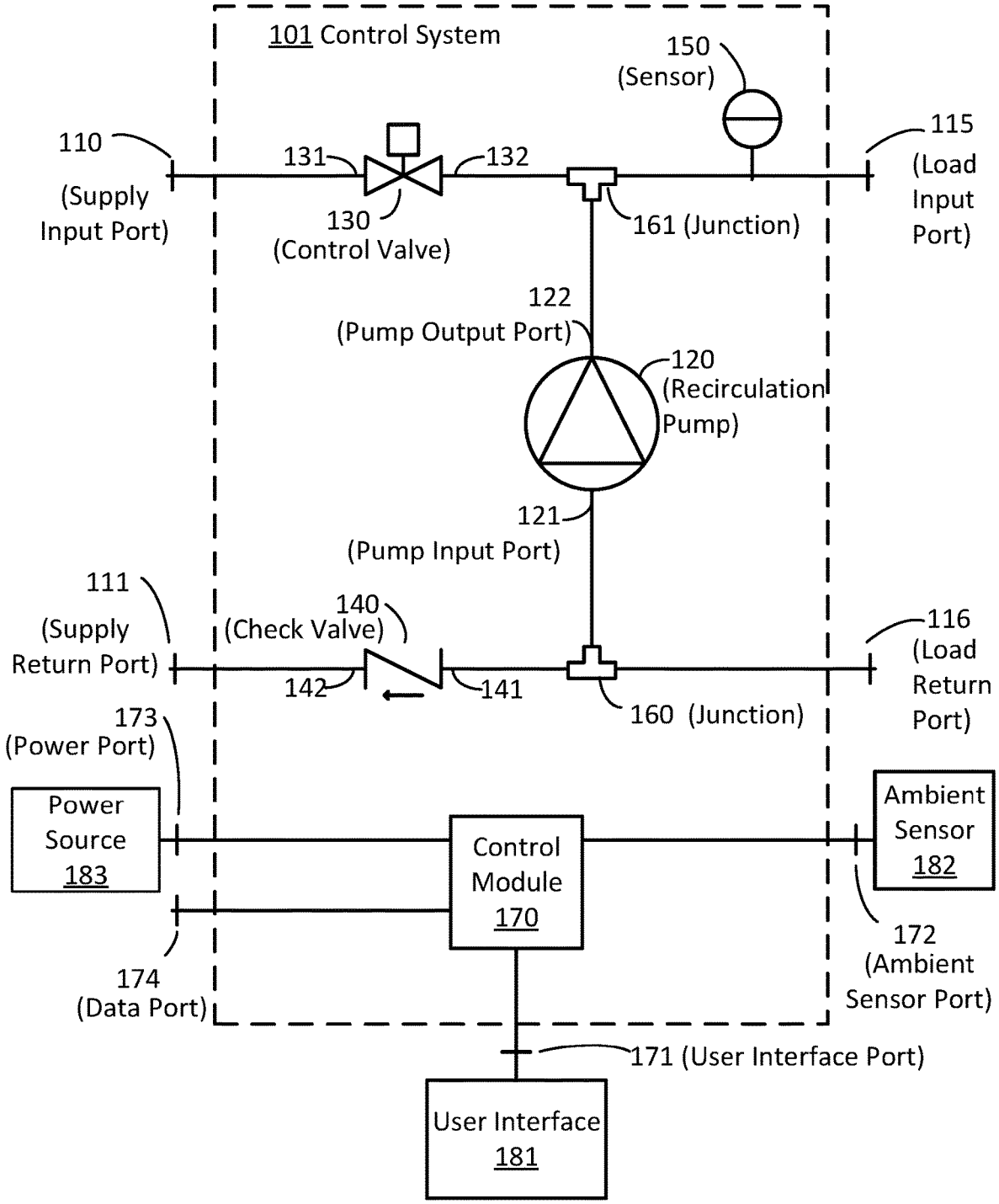
FIG. 1-3 are control systems according to some embodiments.

Chilled beams in combination with an ERV are starting to be used to overcome problems with conventional HVAC systems. Compared to conventional HVAC systems, a system with chilled beams and an ERV can provide much better humidity control, improved indoor air quality, significantly lower energy costs, much quieter living spaces, and reduced maintenance costs. The inventors have recognized and appreciated that a reason the chilled beams and ERV system is not being used more is because of the complicated designs and high costs for the systems that control the chilled beams. Some aspects of the disclosure relate to a control system design that will allow chilled beam and ERV systems to be more economically viable.

The inventors have recognized and appreciated the difficulties in adapting chilled beam system designs for each new installation (e.g., in a building or other facility to have conditioned air). Particularly existing chilled beam control systems can require large, expensive hardware and complicated software control schemes that are difficult to design, install, and tune, driving up installation costs and limiting the viability of the technology. These designs can still have significant limitations that affect comfort such as the inability to provide heating and cooling simultaneously at different chilled beams, and the inability to provide maximum cooling rates in conditioned spaces having different dew point temperatures.

Some embodiments are directed to a control system that controls the flow of cooling or heating liquid from one or more liquid supply systems to a chilled beam (or other suitable conditioning load). The control system may pump a portion of the flow that has already passed through the chilled beam and combine it with liquid from the supply to achieve a flow into the chilled beam that has a desired input temperature (which may be determined, for example, from the ambient conditions and a user specified setpoint temperature). A control valve and recirculation pump may be controlled to vary the relative amounts of the recirculation flow and supply flow to achieve the desired temperature for the liquid flowing into the chilled beam. If a control system is provided with each chilled beam as opposed to using a single control system to control a zone, the need for secondary piping can be eliminated as well as any need for reverse return piping or balancing valves. (Eliminating such piping can significantly reduce design, engineering, and installation costs.) Further, because each chilled beam may be independently controlled, the control system for each chilled beam can be immediately responsive to the specific heating and cooling demands of its chilled beam rather than having to prioritize competing demands as may be the case in zone-based control systems that serve multiple conditioning loads (e.g., multiple chilled beams).

FIGS. 1-6 show embodiments of a single supply control system. The features and concepts introduced with respect to the single supply control systems may also be applicable to the two-supply control system later discussed with reference to FIGS. 7-8.

Referring now to FIG. 1, a control system 101 for controlling liquid flow from a supply into a chilled beam or other suitable conditioning load is shown. Control system 101 has a supply input port 110 and supply return port 111. When connected to a liquid supply system a relatively larger liquid pressure may be connected to input port 110 and a relatively lower liquid pressure connected to port 111. Liquid supply systems are discussed further herein, for example, in connection with FIGS. 4-6, 8, 13, and 14.

Control system 101 has load input port 115 and load return port 116. The input and return ports of a chilled beam or other conditioning load may be connected to ports 115 and 116, respectively.

Ports 110, 111, 115, and 116 and all ports internal to the control system for handling liquid are of a type suitable for requirements of a particular embodiment of control system 101. Those of skill in the art appreciate that the appropriate materials for a port may depend on many factors such as the anticipated liquid pressure, the volume of liquid flow, and requirements of other components in the system. Ports may be of a type that allow for normal connecting and disconnecting (e.g., pipe connector, pipe fitting, hose clamps, couplings), or may be permanently attached such as by soldering, welding, or even continuous conduit. The latter may be practical, for example, in embodiments where control system 101 is assembled with the conditioning load or liquid supply system. The choice of the type of port connection may consider factors such as where the connection will take place and how likely it is that the port needs to be disconnected in the future to support, for example, maintenance of the system.

Control system 101 has a recirculation pump 120. Pump 120 has a pump input port 121 and a pump output port 122. Pump 120 pumps liquid from pump input port 121 to pump output port 122. Pump input port 121 is connected to a first junction 160 and pump output port 122 is connected to second junction 161. Pump 120 may be a single (fixed) speed pump, or a multi- or variable-speed pump in some embodiments. Pump 120 may be sized to pump only a fraction of the flow rate associated with an attached conditioning load since only a portion of the flow returning from the load is pumped by pump 120.

In some embodiments, pump 120 is a fixed speed pump sized such that the flow rate of liquid through load input port 115 is within a target flow rate range or approximately a target flow rate for the conditioning load over a range of positions for control valve 130. This target or target range for the flow rate may be specified by the conditioning load's manufacture or determined by its construction.

A first junction 160 splits liquid received from load return port 116; a first portion is directed to pump input port 121 for recirculation while a second portion is returned to the liquid supply system via supply return port 111. While junction 160 is illustrated by a T-type fitting in FIG. 1, it should be appreciated that any suitable device for splitting the liquid may be used.

A second junction 161 combines liquid received from supply input port 110 and pump output port 122 and provides the combined liquid to load input port 115. While junction 160 is illustrated by a T-type fitting in FIG. 1, it should be appreciated that any suitable device for combining the liquid may be used.

It is noted that in some embodiments junctions 160 and 161 are made from the same type of component (e.g., a T-type fitting) which may be able to provide both splitting of a liquid flow and combining a liquid flow. In some other embodiments, junctions 160 and 161 use different component types. The use of different component types for junctions 160 and 161 may be to provide better performance of the splitting and combining functions of the respective junctions. Second junction 161 may, for example include a mixer such as a static helical mixer that improves mixing of the combined flows (this may be beneficial in some embodiments to achieve an accurate temperature reading of the combined flow).

Control system 101 may include a control valve 130 for restricting flow of liquid between supply input port 110 and supply return port 111. Control valve 130 has a first port 131 and a second port 132. In control system 101, control valve 130 is connected between supply input port 110 and junction 161. Control valve 130 may be adjustable from completely closed to completely opened through intermediate positions. If control valve 130 is completely closed, flow of liquid is prevented between ports 131 and 132. If control valve 130 is completely open, control valve 130 presents its minimum restriction to the flow of liquid. The intermediate positions provide intermediate levels of restriction to the flow of liquid between ports 110 and 111. In some embodiments control valve 130 can assume discrete intermediate positions (e.g., in some embodiments utilizing digital control), while in some other embodiments control valve 130 can be continuously controlled in intermediate positions between open and closed (e.g., in some embodiments utilizing analog control).

Figure 2:
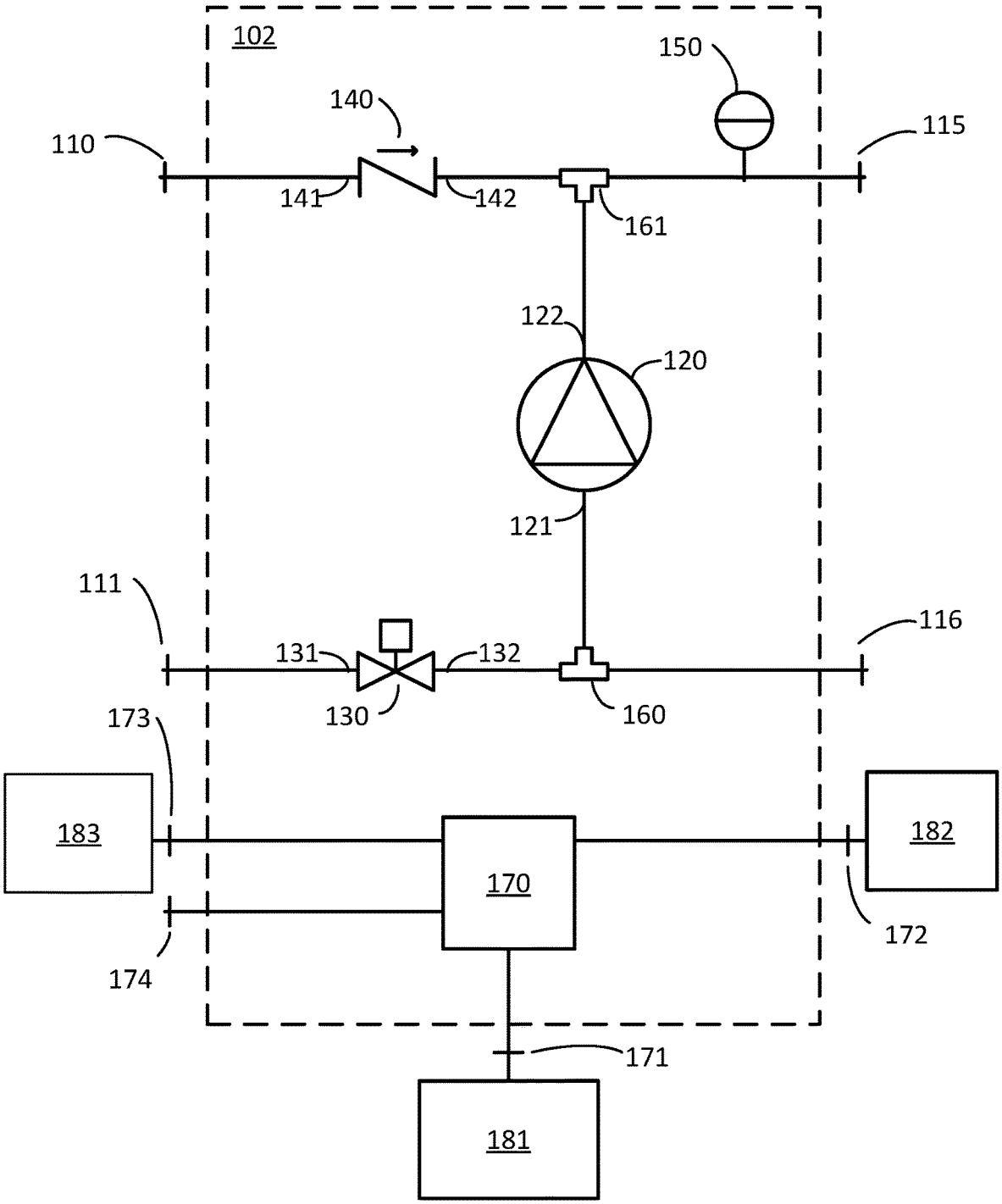

While the direction of liquid flow in control valve 130 may not be directly controlled by control valve 130, a check valve 140 may be provided to prevent reverse flow in control system 101. Reverse flow might otherwise occur for example, if the pressure at supply return port 111 is greater than the pressure at supply input port 110. Check valve 140 has an input port 141 and an output port 142. Check valve 140 prevents flow from output port 142 to input port 141 but allows flows from input port 141 to output port 142. Check valve 140 is connected between supply return port 111 and first junction 160. In control system 101, check valve 140 is oriented to allow liquid to flow through check valve 140 to supply return port 111. If control system 101 is connected to a load such as a chilled beam, which does not allow a net flow of liquid between load input port 115 and load return port 116 this orientation of check valve 140 will further ensure that flow through control valve 130 is from first port 131 to second port 132. FIG. 2 shows another embodiment, control system 102, where the position of control valve 130 and check valve 140 are switched. (The descriptions of embodiments of control system 101 otherwise applying equally to control system 102.) Note that the direction of check valve 140 is such as to allow flow in the direction from supply input port 110 to supply output port 111. As will be discussed in connection with FIGS. 7-8, both configurations may be used simultaneously in two supply control systems.

Control system 101 further comprises a sensor 150. Sensor 150 may be used to determine the temperature of the liquid entering the load through load input port 115. In some embodiments sensor 150 is a temperature sensor that measures the liquid combined at second junction 161 and conveyed to load input port 115; such a temperature sensor may, for example, be placed inside the hydraulic conveyance (e.g., pipe) between second junction 161 and load input port 115 as indicated in FIG. 1. In some embodiments a Pete's plug is used to allow a temperature sensor such as a thermistor or thermocouple to be inserted into the conduit. In some embodiments a T-shaped fitting may be used to accommodate a temperature sensor. In some embodiments sensor 150 includes a flow meter for measuring the flow rate of the liquid entering the load through load input port 115 and control module 170 controls control valve 130 and pump 120 to achieve a target load flow rate.

Figure 3:
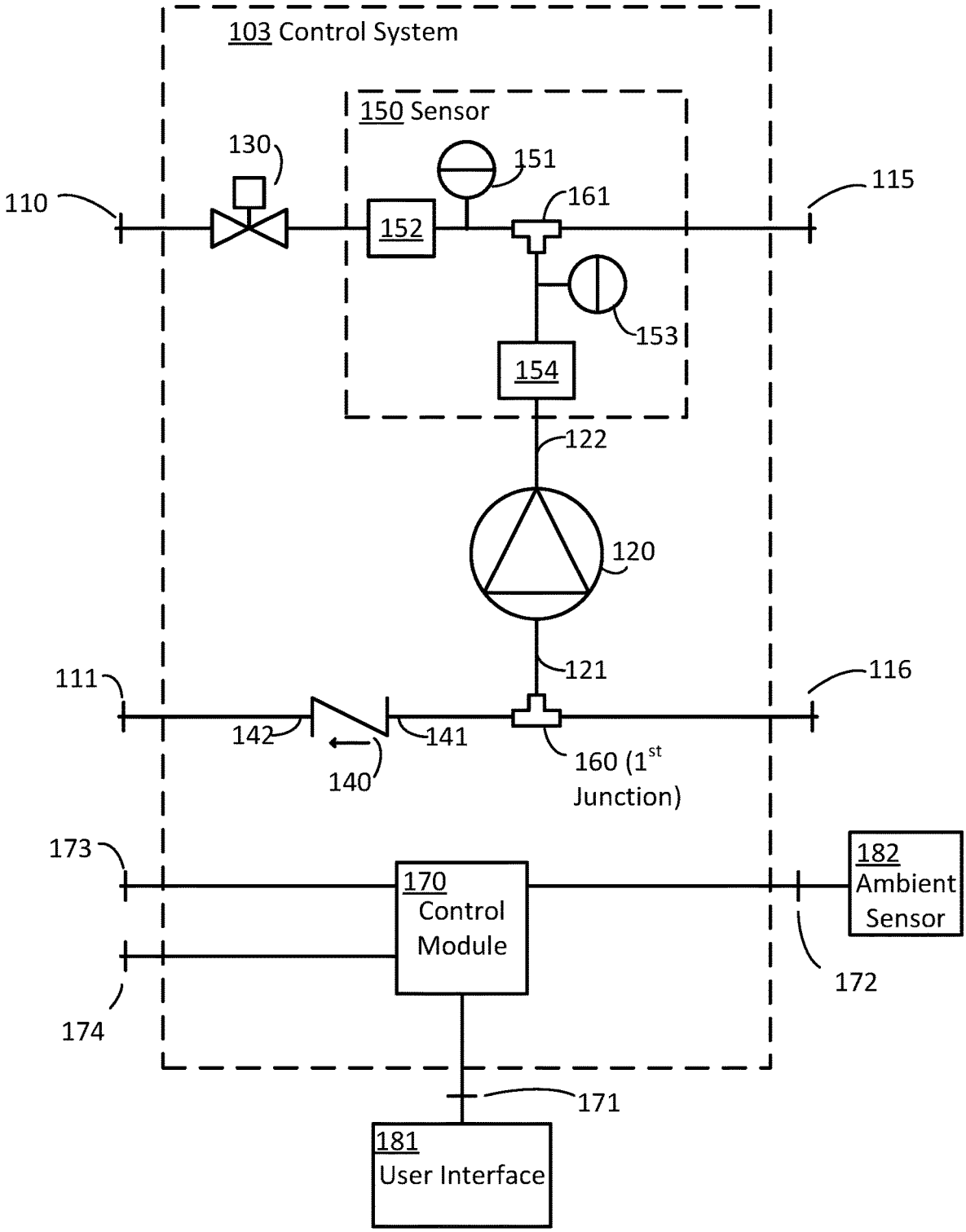

It should be appreciated that the illustration of sensor 150 in FIG. 1 as a temperature sensor between second junction 161 and load input port 115 is illustrative of some embodiments. The temperature of the liquid flowing out of load input port 115 may be measured in other ways. For example, FIG. 3 shows a control system 103 where sensor 150 includes temperature sensors 151 and 153 and flow meters 152 and 154. (The descriptions of embodiments of control systems 101 and 102 otherwise applying equally to control system 103.) Flow meters 152 and 154 measure the rate of liquid flowing through the respective meter. Flow meters 152 and 154 are connected in a suitable way; for example, each flow meter may be connected in line so that all liquid flowing through the relevant pipe also passes through the flow meter. In this example, temperature sensor 151 and flow meter 152 are provided between supply input port 110 and junction 161 to measure the temperature and flow rate of the liquid entering from supply input port 110. Another temperature sensor 153 and flow meter 154 measure the temperature and flow rate of the recirculated liquid and are provided between recirculating pump 120 and junction 161.

The temperature of the liquid flowing to load input port 115, $T_{in}$ can be estimated from these measurements as $T_{in}=(T_{151}F_{152}+T_{153}F_{154})/(F_{152}+F_{154})$, where $T_{151}$ and $T_{153}$ are the temperature measurements of temperature sensors 151 and 153, respectively, and $F_{152}$ and $F_{154}$ are the flow rate measurements of flow meters 152 and 154, respectively.

Figure 4:
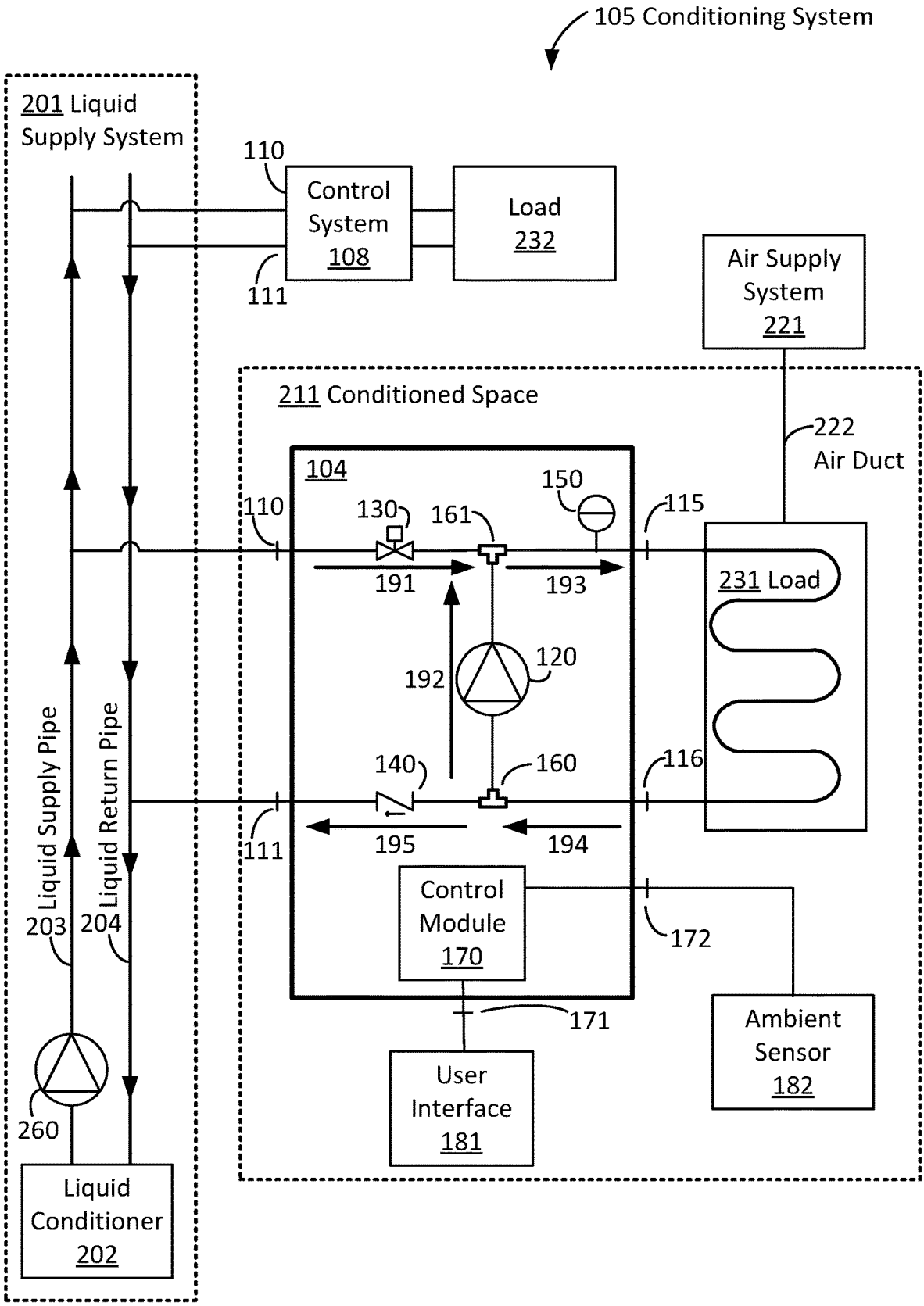
FIG. 4 is a single supply conditioning system including a two-pipe liquid supply system, a control system, and a conditioning load according to some embodiments.

It should be appreciated that other positions and configurations of temperature sensors and flow meters in the control system may also be used to estimate the temperature of the liquid flowing to load input port 115. Refer momentarily to FIG. 4, which shows an embodiment, control system 104, as part of a conditioning system 105. In FIG. 4 five liquid flows are labelled within control system 104, namely (i) supply input flow 191, (ii) recirculation flow 192, (iii) load input flow 193, (iv) load return flow 194, and (v) supply return flow 195. The flow rates associated with these flows are se are abbreviated $F_{191}$, $F_{192}$, $F_{193}$, $F_{194}$, and $F_{195}$ respective. Assuming liquid does not leave the load (e.g., the chilled beam does not leak), there is no net flow on the load ports 115 and 116, thus $F_{193}=F_{194}$. This also implies that there will be no net flow to the supply ports 110 and 111, thus $F_{191}=F_{195}$. By Kirchhoff's law we see that $F_{193}=F_{191}+F_{192}$, and $F_{194}=F_{192}+F_{195}$. Further, assuming the internal piping of the control system is well insulated and that the devices within the control system do not affect the liquid temperature it becomes clear that the temperature of recirculation flow 192, load return flow 194, and supply return flow 195 are the same. In some embodiments, the temperature of the liquid provided by a liquid supply system 201 (or any suitable liquid supply system) to supply input port 110 may be a fixed value controlled by liquid conditioner 202. Thus, control system 104 may be able to assume the temperature of supply input flow 191 is equal to such fixed value, though, in some embodiments, liquid supply system 201 provides a temperature measurement of the supply liquid to control system 104 via a data port (such as data port 174, FIG. 1). Accordingly, temperature sensor 151 may not be installed or required.

It should be clear that multiple sensor configurations can be used to estimate the temperature of the liquid flowing to load input port 115. The use of temperature sensors and flow meters at various points within control system 101, may be desired, for example, to provide greater visibility on the overall performance and improve the efficacy of the chilled beam and the control system. For example, the temperature drop of the liquid between entering a chilled beam through load input port 115 and exiting the beam to load return port 116 along with the flow rate is indicative of the amount of heat transfer occurring on the chilled beam. (An experimental example is discussed in connection with FIG. 14.) As another example, in some embodiments, measurement of the temperature of supply input flow 191 may be used to improve the effectiveness of the control module algorithms (e.g., pump 120 may be turned off if supply input flow alone will provide improved performance over combining it with recirculation flow).

Returning to FIG. 1, control system 101 may include power port 173 which may be connected to a power source 183. Power port 173 may receive electrical power needed to operate control system 101. While power port 173 is shown connected to control module 170, it should be appreciated that power may be provided to various other components of control system 101 directly or through control module 170. In some embodiments, power is provided for internally by control system 101. For example, control system 101 may be battery powered, include a generator, or use a suitable combination of battery storage, generators, and external power sources.

Control system 101 may include control module 170. Control module 170 may control control valve 130 and recirculation pump 120 based on various inputs such as from sensor 150, user interface 181 ambient sensor 182, and remote commands received from data port 174. Some embodiments of control module 170 are described, for example, in connection with FIGS. 10-12. In some embodiments control module 170 includes data port 174 for communicating with other devices such as a control and monitoring center, other control systems, and the like.

In some embodiments, control module 170 has a user interface port 171 for connecting to a user interface such as user interface 181. A user interface 181 may provide an interface for a user of the conditioned space to control system 101. User interface 181 may allow a user to, among other things, indicate whether conditioning of the air in a conditioned space is desired, the type of conditioning (e.g., heating or cooling), a setpoint temperature specifying a desired temperature in the conditioned space, and to create a schedule for operation of control system 101. User interface 181 may also present information about the status of control system 104, the conditioned space, and the like to the user. In some embodiments, user interface 181 is a computer or other electronic device with any suitable combination of user interface devices such as a display, keypad, haptic feedback, speaker, microphone, touch screen, mouse, trackball, and other types of user interface devices.

Control module 170 may have an ambient sensor port 172 for connecting an ambient sensor such as ambient sensor 182. Ambient sensor 182 may measure the ambient conditions of in a conditioned space. For example, ambient sensor 182 may measure the temperature (e.g., "room" or "air" temperature), the humidity, the relative humidity, the dew point temperature, or other conditions in a conditioned space. In some embodiments multiple ambient sensors are used, for example, a first set of one or more sensors may be used to measure conditions such as dew point at or near the chilled beam while a second set of one or more sensors may be used to measure a temperature representative of the conditioned space.

It should be appreciated that any suitable hydraulic conveyance may be used between the various hydraulic components of control system 101. If hydraulic conveyances are circular in cross-section, the internal diameter may be between 0.25 and 2.5 inches (e.g., about ½, ¾, 1, 1.5, 2 inch diameter, or any combination of ranges such between ½ in to 1 in.). For example, ½, ¾, 1, or 2 in. nominal pipe diameter may be used. Control system 101 may be designed such that the total length of its hydraulic conveyances is the least practical in view of considerations such as proper operation, the ease of repair. In some embodiments the total length of hydraulic conveyances is less than 25, 50, 75, 100, 250, or 500 equivalent internal diameters of the hydraulic conveyance. For example, an embodiment with ½ inch pipe may have a total length of hydraulic conveyances less than 25 inches.

Figure 5:
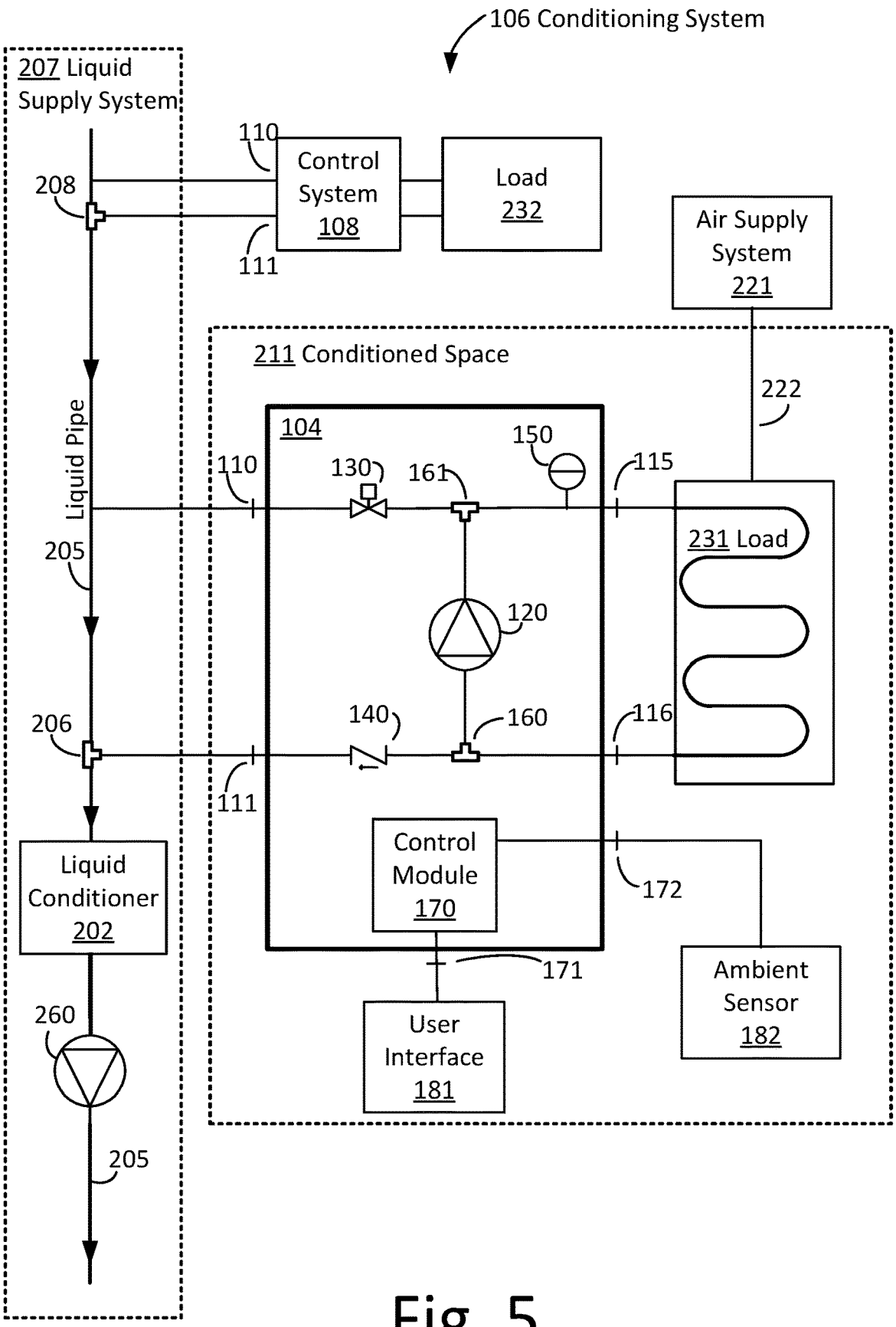
FIG. 5 is a single supply conditioning system including a single-pipe, diverter tee liquid supply system; a control system; and a conditioning load according to some embodiments.
Figure 6:
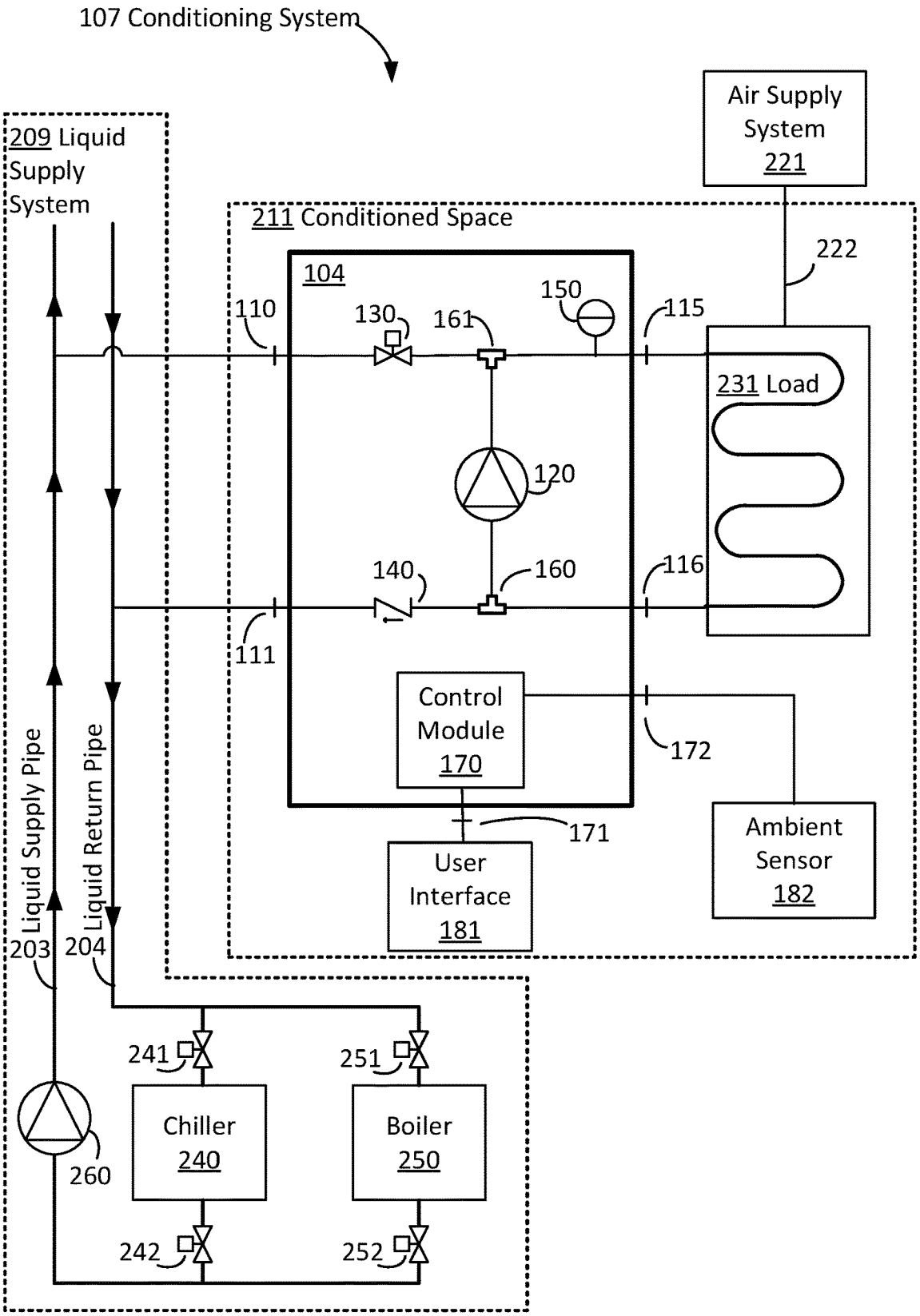
FIG. 6 is a single supply conditioning system including a two-pipe, switchable chiller/boiler liquid supply system; a control system; and a conditioning load according to some embodiments.

Having discussed embodiments of a control system with reference to FIGS. 1-4, the use of the control system as part of a conditioning system is discussed with references to FIGS. 4-6. While FIGS. 4-6 refer to control system 104, it should be appreciated that other embodiments (e.g., control systems 101, 102, 103) or aspects of other embodiments of the control system may be used with the described conditioning systems. The examples in FIGS. 4-6 are exemplary and the control system may be used in other conditioning systems and with other liquid supply systems.

FIG. 4 shows conditioning system 105 using a control system 104. Conditioning system 105 includes a liquid supply system 201, a conditioned space 211, an air supply system 221, control system 104 and conditioning load 231 (among other elements).

Conditioning system 105 is a system for conditioning one or more conditioned spaces such as conditioned space 211. Conditioned space 211 is a volume where one or more environmental parameters such as temperature and humidity are to be controlled by conditioning system 105. Examples of volumes that may be suited for conditioning include but are not limited to the rooms of a house, condo, hotel, or office; retail space; or office buildings; commercial real estate, industrial buildings; factories; hangers; boats, aircraft, vehicles, and other indoor environments.

Liquid supply system 201 provides conditioned liquid. Liquid supply system 201 may be referred to as a "two-pipe system". A liquid conditioner 202 conditions liquid to have desired characteristics (e.g., to have a particular temperature or to be within a specific temperature range). Pump 260 pump the conditioned liquid through liquid supply system 201. Liquid conditioner 202 may include a chiller and/or a boiler, though any suitable device for conditioning the liquid may be used. The liquid may be water, water with additives to improve performance (e.g., to reduce the risk of freezing), or any other suitable liquid. Liquid returns to liquid conditioner 202 via a liquid return pipe 204. Liquid supply pipe 203 and liquid return pipe 204 are connected to the supply input port 110 and supply return port 111, respectively, of control system 104. Supply pipe 203 and return pipe 204 may be similarly connected to any number of control systems similar or identical to control system 104, or any other devices that may utilize the conditioned liquid provided by liquid supply system 201. To illustrate this concept a control system 108 and load 232 are also shown connected to liquid supply system 201. For simplicity only control system 108 and load 232 are shown; they may have additional components and may be in conditioned space 211 or another conditioned space. In some embodiments, 10s, 100s, or even 1,000s of additional devices may be connected, however, in some embodiments of conditioning systems 105, control system 104 may be the only device connected to liquid supply system 201.

In some embodiments liquid supply system 201 may be a "cold" liquid supply system or a "hot" liquid supply system. A cold supply system may utilize a chiller for liquid conditioner 202 to cool the liquid, for example, to a temperature between above 32° F. and about 60. The temperature may be a fixed value (e.g., 35, 40, 45, 50, 55, 58° F.) to within a tolerance (e.g., degree or two) though requirements may differ with different embodiments. Similarly, a hot supply system may utilize a boiler to heat a liquid, for example, to a temperature between about 100 and 180° F. The temperature may be a fixed value (e.g., 110, 120, 130, 140, 150, 160, 170, 180° F.) to within a tolerance (e.g., a few degrees) though requirements may differ with different embodiments. It may not be critical that the temperature of a liquid from a supply source be known or tightly controlled as some embodiments control system 104 can dynamically adapt to respond to changing supply conditions.

Liquid supply pipe 203 and liquid return pipe 204 may each terminate after connection of all devices to liquid supply system 201, though in some cases they are connected together to provide a complete flow path even when all connected devices are not using liquid from the system. In some cases, a bypass (not shown) is used to prevent deadheading pump 291.

Conditioning load 231 is located at/in conditioned space 211. Load 231 may be a chilled beam, fan coil unit, another device for heat transfer with conditioned space 211, or any other suitable device. In some embodiments, load 231 is a two-port device with an input which receives liquid; the liquid flows through piping within load 231 allowing energy transfer with conditioned space 211 and exits via a return port. The piping may be coiled to increase the amount of energy transfer that takes place prior to returning the liquid flow. Control system 104 is connected to load 231 by load input port 115 and load return port 116. Control system 104 may be designed to match the requirements of load 231. For example, load 231 may be a chilled beam designed to receive about 1 to 2 gallons per minute of liquid. The pipes, pump, and ports of control system 104 may be selected for the efficient operation of such a chilled beam.

In some embodiments air supply system 221 provides air to load 231. For example, load 231 may be an active chilled beam where the air supplied by air supply system 221 enhances air flow past the coil of the active chilled beam. Air flow over piping in load 231 may enhance energy transfer between the load and conditioned space as well as improve distribution of conditioned air in conditioned space 211. In some embodiments air supply system 221 provides air to load 231 via an air duct 222. In some other embodiments, air supply system 221 provides increased air flow over load 231 without a duct. Air supply system 221 may be a dedicated outdoor air system (DOAS) and may feature an energy recovery ventilator (ERV). It is noted that some systems, such as those utilizing a passive chilled beam may be designed to operate without an air supply system.

Ambient sensor 182 is provided in conditioned space 211 to measure one or more properties in conditioned space 211. In some embodiments, ambient sensor 182 is positioned proximal to load 231, though ambient sensor 182 may be positioned anywhere in conditioned space 211. As discussed below in connection with FIGS. 10-12, control module 170 may use ambient sensor 182 as an input for control decisions. In some embodiments, multiple ambient sensors may be used to sense the condition of the air at different locations, such conditions to be used as further inputs to the control decision process or simply provided for informational purposes.

In some embodiments, control module 170 varies the relative amounts of recirculation flow 192 and supply input flow 191 that are mixed to form load input flow 193 by controlling control valve 130 and recirculation pump 120. Control module 170 may control pump 120 and control valve 130 to achieve a target condition, such as the temperature of load input flow 193 or the flow rate of load input flow 193, or the ambient temperature in conditioned space 211. One or more target conditions may be determined based on inputs received by control module 170. For example, in a cooling mode (e.g., liquid conditioner 202 being a chiller) with recirculation pump 120 turned on, control module 170 may open control valve 130 more to allow more supply input flow 191 (e.g., cold water) to mix with recirculation flow 192 reducing the temperature of load input flow 193. As a result of the flow rate of supply input flow 191 increasing the pressure differential across pump 120 may also increase resulting in a reduction in the flow rate of recirculation flow 192. Similarly, if control valve 130 is closed more to reduce the temperature of load input flow 193, supply input flow rate 191 may decrease and recirculation flow 192 may increase. The heating mode may be analogous. In some embodiments of control system 104, even as control valve 130 varies position the flow rate of load input flow 193 is relatively constant (e.g., within 5%, 10%, 20% or 25% of the maximum or minimum flow rate) because of an inverse relationship between supply input flow 191 and recirculation flow 192 as control valve 130*s* position is changed.

FIG. 5 shows a conditioning system 106 using a control system 104. This system is similar to conditioning system 105 in FIG. 4 except that another liquid supply system design has been provided. Liquid supply system 207 may be referred to as a diverter-tee system as it features diverter tees, such as diverter tee 206, that restrict flow in order to provide a pressure differential between supply input port 110 and supply return port 111 that is suitable for operation of control system 104 and load 231. This allows liquid supply pipe 205 of liquid supply system 207 to connect in sequence to both the supply input and return ports of a device before connecting to another device. One or more devices such as control system 104 may be connected to liquid supply system 207. A simplified illustration of a control system 108 with a load 232 is shown to illustrate the connection of additional devices in conditioning system 106. A diverter tee 208 providing a suitable pressure drop for the operation of control system 108. While diverter tees 206 and 208 are illustrated at the return connection, it should be appreciated that diverter tees may be located either or both the input and return branches. It is noted that pipe 205 forms a loop, thus the sequence of attaching a number of devices may significantly impact the total length of pipe 205. An advantage of liquid supply system 207 over system 201 is significantly less pipe may be needed to connect the same number of devices to supply system 207.

A third example of a conditioning system utilizing control system 104 is shown in FIG. 6. Conditioning system 107 has a liquid supply system 209 which has a chiller 240, boiler 250 and a pump 260. Chiller 240 cools the liquid in supply system 209 and boiler 250 heats the liquid in supply system 209. Liquid supply system is connected to devices such as control system 104 in ways similar to those discussed in connection with conditioning system 105 (FIG. 4). Such a system allows a single supply control system such as control system 104 to be used for both heating and cooling. Valves 241, 242, 251, and 252 may be used to control whether liquid cooled by chiller 240 or liquid heated by boiler 250 flows through the piping of liquid supply system 209. An operator, for example, may open valves 241 and 242 and close valves 251 and 252 during periods of time requiring cooling in conditioned space 211, and switch the configuration of the valves for periods of time requiring heating in conditioned space 211. This may be done, for example, once a year with the disconnected device powered down during the dormant period. In some other embodiments, valves 241, 242, 251, and 252 are appropriately replaced with 3-way valves. While liquid supply system 209 is illustrated as a two-pipe system, it should be appreciated that a similar configuration could be achieved by adapting the diverter tee liquid supply system 207 to have valves to select between multiple liquid conditioners such as a boiler and a chiller.

A disadvantage of the single supply control systems described with reference to FIGS. 1-6 is that the control system can only heat or cool to the temperature of the liquid made available at supply input port 110 by the connected liquid supply system. If some devices connected to a single liquid supply system require hot liquid (for heating) and others require cool liquid (for cooling) not all conditioning demands can be simultaneously met. Similarly, a control system may be trying to provide cooling through a chilled beam at one time of day and heating at another and unless the liquid supply system changes to meet such need (a solution that may not be practical) only heating or cooling will be available, but not both.

Figure 7:
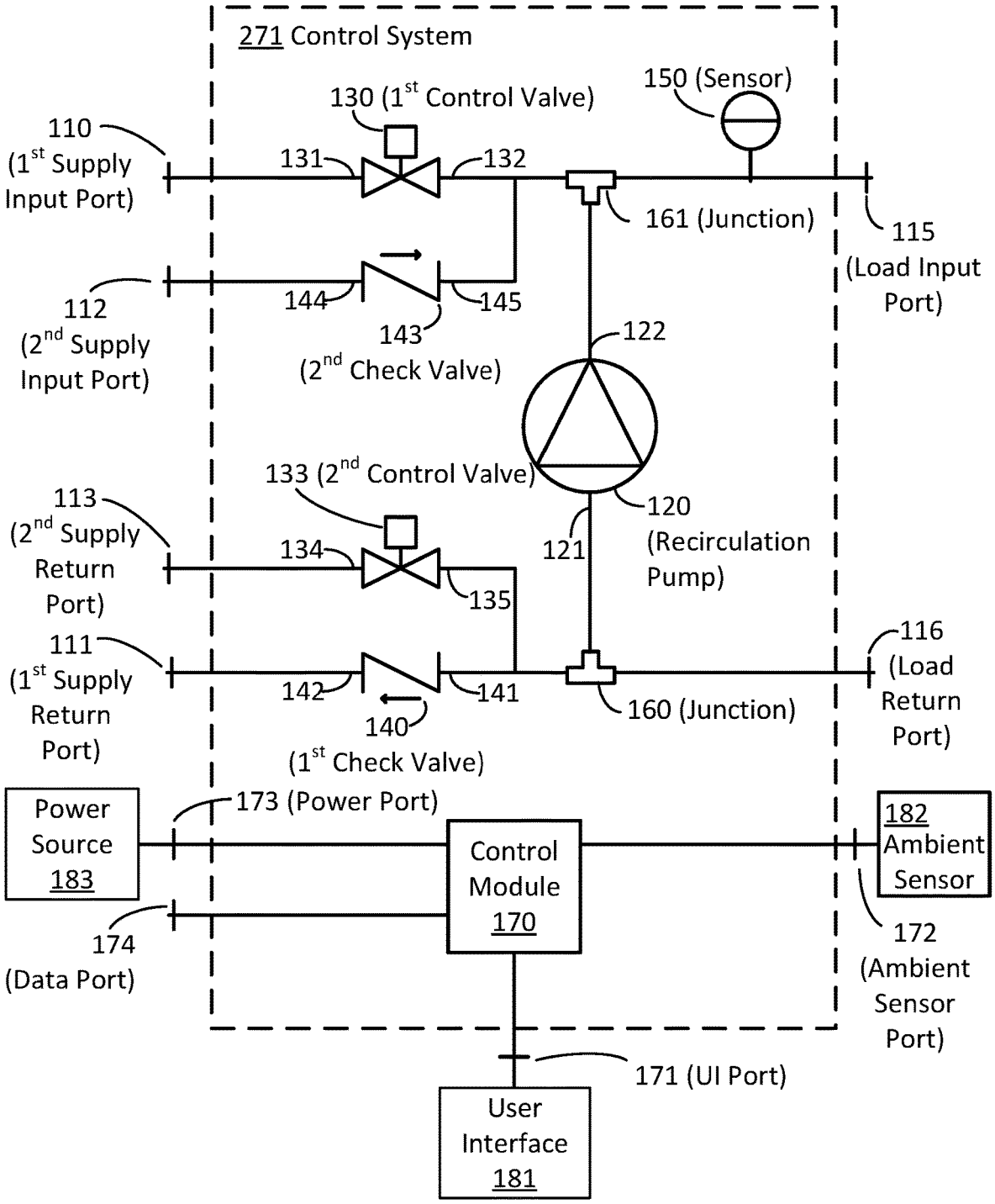
FIG. 7 is a two supply control system according to some embodiments.
Figure 8:
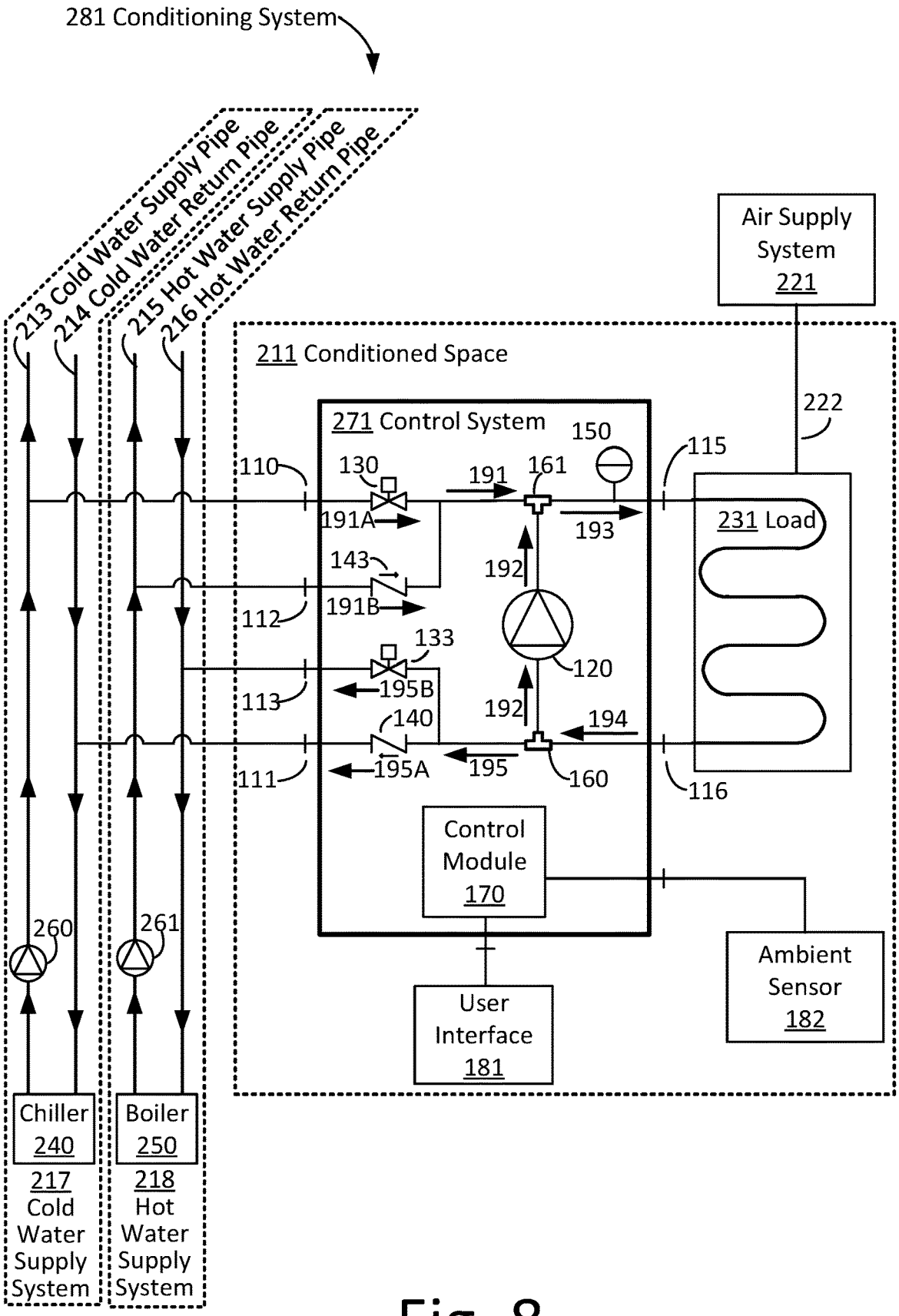
FIG. 8 is a conditioning system including a four-pipe liquid supply system, a control system, and a conditioning load according to some embodiments.

Introduced in FIGS. 7-8 are two-supply control systems for controlling conditioning loads such as a chilled beam. Two-supply control systems may be connected to a "cold" liquid supply system and a "hot" liquid supply system so that cooling and heating is available at any time for the conditioned space being managed by the control system.

FIG. 7 shows a two-supply control system 271 according to some embodiments. Note that the designation of "first" and "second" with respect to the supply ports, the control valves and check valves is not an indication of priority, precedence, or order. The purpose is merely to distinguish between elements.

In control system 271 first supply input port 110 and first supply return port 111 may be connected to a first liquid supply system. Second supply input port 112 and second supply return port 113 may be connected to a second liquid supply system. When connected to their respective liquid supply systems, a relatively larger liquid pressure may be exerted at input ports 110 and 112 relative to the respective return ports 111 and 113.

Control system 271 includes first control valve 130 having ports 131 and 132, and second control valve 133 have ports 134 and 135. First control valve 130 and second control valve 133 may be similar to embodiments of control valve 130 described with reference to FIGS. 1-6.

Control system 271 also includes first check valve 140 having input ports 141 and output port 142, and second check valve 143 have input port 144 and output port 145. First check valve 140 and second check valve 143 allow flow of liquid from their respective input ports to their respective output ports and prevent flow in the opposite direction. Check valves 140 and 143 may be similar to embodiments of check valve 140 described with reference to FIGS. 1-6.

In control system 271, first control valve 130 may be connected between first supply input port 110 and junction 161 and first check valve 140 may be connected between junction 160 and first supply return port 111. First check valve 140 may be oriented to allow flow of liquid out of port 111. This configuration is similar to the configuration of control valve 130 and check valve 140 in control system 101, described with reference to FIG. 1.

In control system 271, second control valve 133 is connected between first junction 160 and second supply return port 113 and second check valve 143 is connected between second supply input port 112 and second junction 161. Second check valve may be oriented to allow flow of liquid into control system 271 from port 112. This configuration of control valve 133 and check valve 143 is similar to the configuration of control valve 130 and check valve 140 in control system 102, described with reference to FIG. 2.

Control system 271 may be configured to permit flow of liquid from only one of the two supplies at any given time. This may be achieved by assuring that at least one of the control valves 130 and 133 is always closed. (Which valve is closed can be switched by first completely closing both control valves.)

FIG. 8 shows a conditioning system 281 according to some embodiments. Conditioning system 281 includes two-supply control system 271 connected to a load 231 for conditioning conditioned space 211. Conditioning system 281 also includes cold water supply system 217 and hot water supply system 218.

Cold water supply system 217 includes a chiller 240 for cooling water. A pump 260 for pumping the cold water to the devices along cold-water supply pipe 213. The cold water returns to chiller 240 along cold-water return pipe 214. Similarly, hot water supply system 218 includes a boiler 250 for heating water and a pump 261 for pumping the hot water to the devices along hot water supply pipe 215. The hot water returns along hot water return pipe 216.

Although only one device (i.e., control system 271) is shown connected to supply systems 217 and 218 it should be appreciated that any number of devices may be connected to such liquid supply systems as was discussed previously, for example, in connection with liquid supply system 201 of FIG. 4.

First supply input port 110 of control system 271 is connected to cold water supply pipe 213 of cold-water supply system 217; first supply return port 111 is connected to cold water return pipe 214. Similarly, second supply input port 112 is connected to hot water supply pipe 215 of hot water supply system 218 and second supply return port 113 is connected to hot water return pipe 216.

FIG. 8 shows the flow of liquid within control system 271. Included are the same flows of liquid as were discussed with reference to the single supply control system 104 in FIG. 4, namely (i) supply input flow 191, (ii) recirculation flow 192, (iii) load input flow 193, (iv) load return flow 194, and (v) supply return flow 195. The operation of these flows is identical to the earlier discussion except that supply input flow 191 originates from port 110 or port 112 and supply return flow 195 is returned to port 111 or port 113. Specifically, first supply input flow 191A and second supply input flow 191B combine to form supply input flow 191; and supply return flow 195 is divided into first supply return flow 195A and second supply return flow 195B.

In some embodiments, only one of first supply input flow 191A and second supply input flow 191B has a non-zero flow rate at any given time. Similarly, only one of first supply return flow 195A and second supply return flow 195B has a non-zero flow rate at any given time. These conditions may be achieved by ensuring that at any time at least one of the control valves (130 or 133) is closed. Assuming no loss of liquid in the load (i.e., $F_{193}=F_{194}$), the return flow rates will equal the input flow rates of the respective supply. That is, using the same notation adopted earlier $F_{191A}=F_{195A}$ and $F_{191B}=F_{195B}$.

While control system 271 has only been shown in conditioning system 281 with a four-pipe liquid supply system (i.e., two two-pipe liquid supply systems) it should be appreciated that any suitable liquid supply system may be used. For example, diverter tee type liquid supply systems may be used.

Figure 9:
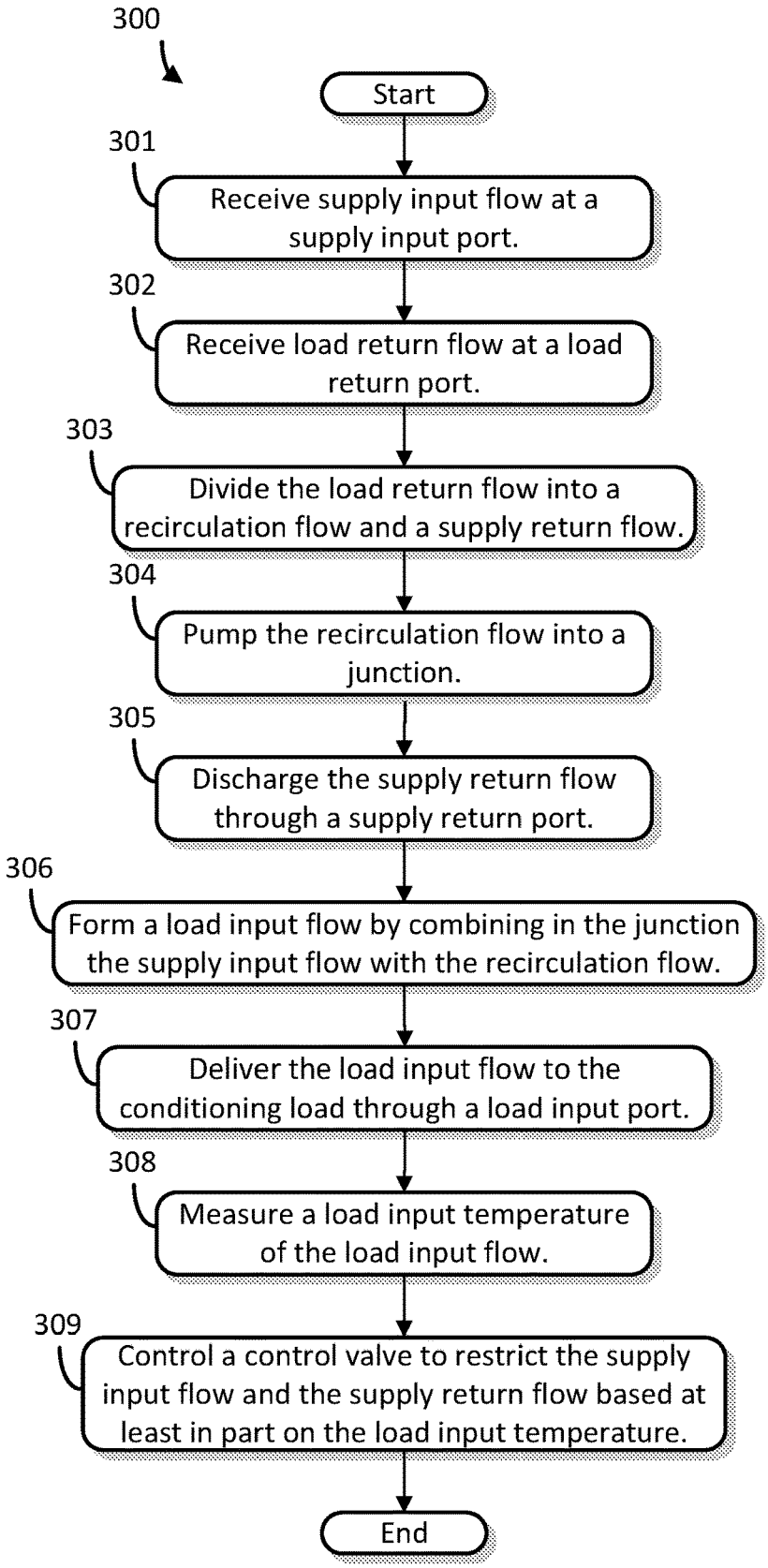
FIG. 9 is a method of controlling flow of a liquid from a liquid supply system into a conditioning load according to some embodiments.

A method 300 of controlling flow of a liquid from a liquid supply system into a conditioning load is discussed with reference to FIG. 9. Some of the embodiments of the described control systems may be used to implement method 300. In discussing some of the steps of method 300, reference is made to control system 104 in FIG. 4, however, this is simply an example, and method 300 may be implemented using other control system embodiments or in other suitable ways.

Method 300 begins at step 301 where supply input flow is received at a supply input port. For example, in FIG. 4, supply input flow 191 is received through supply input port 110. The supply liquid flow may be received from a liquid supply system such as liquid supply system 201.

At step 302, method 300 receives a load return flow at a load return port. For example, in FIG. 4, load return flow 194 is received through load return port 116. The load return flow may be received from a conditioning load such as load 231.

At step 303, method 300 divides the return liquid into a recirculation flow and a supply return flow. For example, in FIG. 4, junction 160 divides load return flow 194 into recirculation flow 192 and supply return flow 195.

At step 304, method 300 pumps the recirculation flow into a junction. For example, in FIG. 4, recirculation pump 120 pumps recirculation flow 192 into junction 161.

At step 305, method 300 discharges the supply return flow through a supply return port. For example, in FIG. 4, supply return flow is discharged through supply return port 111 back to liquid supply system 201.

At step 306, method 300 forms a load input flow by combining in the junction the supply input flow with the recirculation flow. For example, in FIG. 4, supply input flow 191 and recirculation flow 192 are combined in junction 161 to form load input flow 193.

At step 307, method 300 delivers the load input flow to the conditioning load through a load input port. For example, in FIG. 4, load input flow 193 is delivered to load 231 via load input port 115.

At step 308, method 300 measures a load input temperature of the load input flow. For example, in FIG. 4, sensor 150 measures the temperature of load input flow 193. It should be appreciated that the temperature of the load input flow may be measured less directly, for example, if the flow rates and temperatures of the supply input flow and the recirculation flow are known, the temperature of the load input flow can be calculated.

At step 309, method 300 controls a control valve to restrict the supply of liquid based at least in part on the load input temperature. For example, in FIG. 4, control module 170 provides a control signal to control valve 130 causing control valve 130 to restrict the rate of supply input flow 191.

Figure 10:
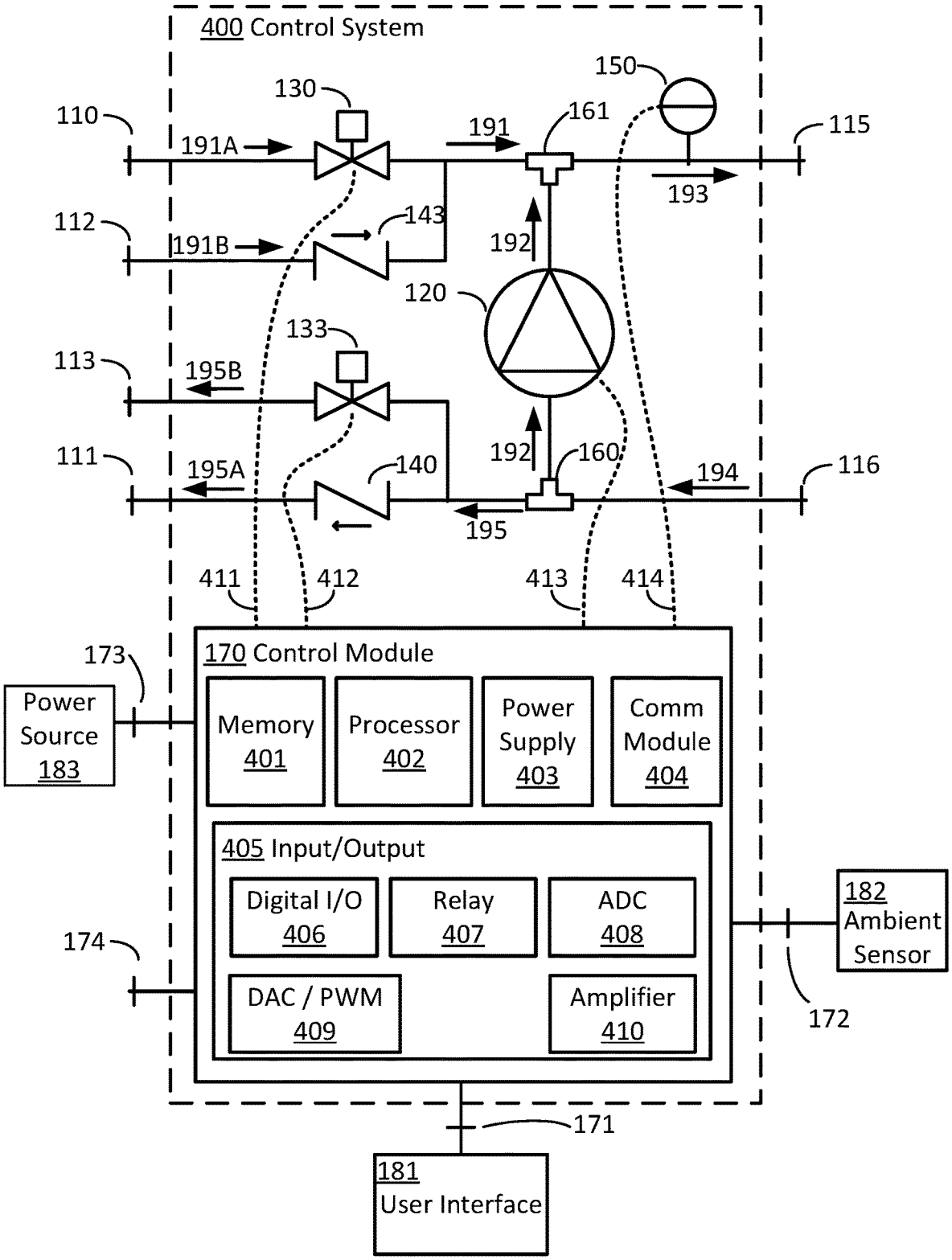
FIG. 10 is another control system according to some embodiments.

Having discussed primarily the mechanical operation of embodiments of a control system, some additional aspects of some embodiments of control module 170 are discussed with reference to control system 400 in FIG. 10. Control system 400 is a two-supply control system like control system 271 in FIGS. 7-8. It should be clear however that the control module 170 can be used in or easily adapted for use in a single supply control system such as those discussed in connection with FIGS. 1-6.

Control module 170 may receive input signals from sensor 150, ambient sensor 182, user interface 182 and via data port 174. Control module 170 may be configured to send control signals to first control valve 130, second control valve 133, and recirculation pump 120. Control module 170 may also send information such as the input signals, control signals, and status of control system 400 to other devices via data port 174.

Control module 170 may include a plurality of modules such as memory 401, processor 402, power supply 403, communications module 404, and input/output (I/O) modules 405.

Processor 402 may be configured to implement control algorithms in response to input signals received by control module 170. Processor 402 may be operatively connected to memory 401 and other modules of control module 170. Processor 402 may be any suitable processing device such as for example and not limitation, a central processing unit (CPU), digital signal processor (DSP), field programmable gate array (FPGA), application specific integrated circuit (ASIC), or any suitable processing device. In some embodiments, processor 402 comprises one or more processors, for example, processor 402 may have multiple cores and/or multiple microchips.

Memory 401 may be integrated into processor 402 and/or may include "off-chip" memory that may be accessible to processor 402, for example, via a memory bus (not shown). In some embodiments, memory 401 stores software modules that when executed by processor 402 perform desired functions; in some embodiments memory 401 stores an FPGA configuration file for configuring processor 402. Memory 401 may be any suitable type of non-transient, computer-readable storage medium such as, for example and not limitation, RAM, ROM, EEPROM, PROM, volatile and non-volatile memory devices, flash memories, or other tangible, non-transient computer storage medium.

Power supply 403 provides the power signals for the operation of control module 170 and other electrical devices in control system 400. Power supply 403 may use power source 183 to facilitate generation of such power signals, though other sources of power may be used. For example, power source 183 may provide a 120V AC power signal to control system 400. Power supply 403 may convert the provided AC signal into DC voltage signals suitable for operation of various components of control system 400—control module 170 may require 3.3V and/or 5V, control valves 130 and 133 may require 24V, and recirculation pump may require 12V. Thus, power supply 403 may convert the 120V AC power signal into these various DC voltage signals, or any other signals based on the requirements of a particular embodiment.

Communications module 404 may be any suitable combination of hardware and software configured to generate and receive communication signals over data port 174. Data port 174 may include a wired data port, a wireless data port, or both. Data port 174 may provide a connection to a network such as a LAN, WAN, the internet, and/or another device using any suitable communications protocol. Communications module 404 may be configured to communicate with other control systems, a centralized control and monitoring center, or any other device. For example, multiple controls systems may be connected together and to a control and monitoring center to facilitate data logging, reconfiguration of the connected control systems and the like. In some embodiments, multiple control systems are daisy chained together; to facilitate this port 174 may include two or more physical connectors to allow each control system to be connected by cable into the next. Other suitable network topologies may also be used.

I/O 405 may include digital I/O 406, relay 407, analog-to-digital converter 408 (ADC 408), digital-to-analog converter/pulse width modulator 409 (DAC/PWM 409), and amplifier 410. I/O 405 permits signaling with other devices and sensors connected to control module 407. I/O 405 is not limited to these types of input and output, and the discussion of the use of I/O 405 is exemplary and other input/output mechanisms may be used in other embodiments.

Digital I/O 406 allows for digital signaling of input and/or output signals. For example, sensor 150, ambient sensor 182, or user interface 181 may utilize digital communication protocols that utilize digital I/O 406.

Relay 407 may be used to facilitate the use of a low voltage digital I/O (e.g., 3.3V, 5V) to control a higher voltage signal. For example, recirculation pump 120 may require a 12V power signal drawing 1 Amp of current to run the pump. A digital I/O pin may only be able to provide, say, a 5V signal with a 15 mA maximum current. The use of a properly configured relay 407 can allow such a digital I/O pin to control a much higher voltage and current power signal to pump 120.

ADC 408 allows analog signal to be processed digitally by converting such signals into a sequence of digital bits. For example, sensor 150 may be a thermistor which has a resistance that varies predictably with temperature. A suitable circuit (e.g., voltage divider) and ADC 408 may be used to convert a voltage measurement into a digital signal. The digital signal may then be processed by processor 402 (or otherwise) to determine the temperature from the thermistor. As another example, sensor 150 may be a thermocouple whose voltage may be converted to a digital signal directly by ADC 408 or after a suitable signal conditioning circuit (e.g., amplification, low pass filtering).

DAC/PWM 409 represent two forms of outputting an analog voltage signal. Digital-to-analog converters may convert digital inputs into analog outputs with discrete increments (though such increments may be below the noise floor in some cases). Pulse width modulation (PWM) may simulate an analog voltage level by switching between digital values at high frequency. The time average voltage value controlled by varying the duty cycle. Low pass filtering can be used to remove the high frequency switching content leaving the time average voltage signal level. DACs or PWMs may, for example, be used to provide an analog output signal for controlling the control valves 130 and 133.

Amplifier 410 may increase the voltage or current of a low power signal, such as a signal output by digital I/O 406 or DAC/PWM 409. For example, control valve 130 may require an analog voltage input between 2 and 10 volts to vary the valve position from completely closed (e.g., at 2V) to completely open (e.g., at 10V). A PWM signal may be generated by a 3.3V digital device (logic 0 at 0 V, logic 1 at 3.3V)—thus the time average voltage of the PWM signal can only be between 0 and 3.3 volts. To use the PWM signal to control valve 130, amplifier 410 may be configured to multiply the input voltage by a little over 3 and the resultant signal used for control.

Control module 170 may send or receive signals to sensors and actuators associated with control system 400 as well as provide electrical power to such devices. Though, in some embodiments power may be provided directly by power source 183 or another source. Signal channels 411, 412, 413, and 414 may facilitate signaling with first control valve 130, second control valve 133, recirculation pump 120, and sensor 150, respectively. In some embodiments, signal channels 411-414 may also provide power to the respective sensors and actuators. In some cases, the control signal and power may be the same signal. For example, if pump 120 is a fixed speed pump, the control signal may simply be providing the power needed to run the pump. Signal channels 411-414 may be wired or wireless signal channels, or any suitable type of signal channel.

Figure 11:
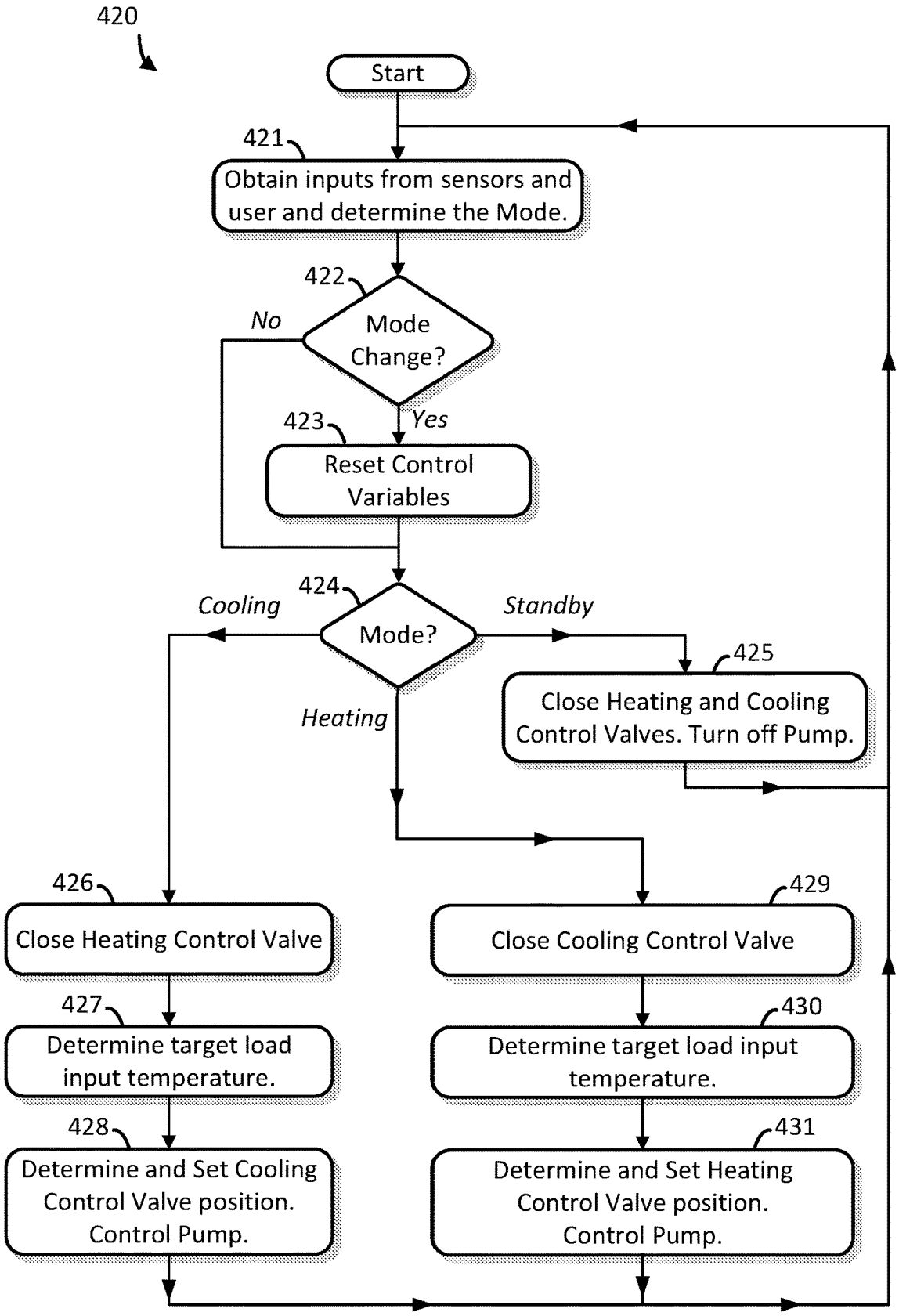
FIG. 11 is a flow diagram for a method of controlling a control system for conditioning indoor air in a conditioned space using a conditioning load according to some embodiments.

Attention is now turned to method 420, shown in FIG. 11, for controlling a control system for conditioning indoor air in a conditioned space using a conditioning load such as a chilled beam, fan coil, or the like. Method 420 may be implemented in any suitable combination of software and hardware. For example, method 420 may be implemented in control module 170 to control system 400. Method 420 is described in connection with reference to control system 400 (FIG. 10), however, it should be appreciated that method 420 may be used to control any suitable two-source control system such as control system 271 shown in FIGS. 7-8.

Method 420 is a control loop that may repeat indefinitely. All paths in the flow diagram return to the first step, step 421, thus completing a loop. For simplicity "stop" conditions have not been shown. If desired, a stop condition may be suitably implemented, for example as an interrupt or as part of "mode" determination. Of course, loss of power may inherently stop method 420 when implemented in an electrical device. It is noted that method 420 may have "memory" in the sense that earlier loops can affect the current loop.

At step 421, method 420 obtains sensor and user inputs. Sensor inputs obtained may include measurements from sensor 150, ambient sensor 182, and other suitable, available sensor inputs. User inputs may include a setpoint temperature, an operating mode, and the like. User inputs may be input by a user via user interface 181 or provided from a device connected via data port 174. Such user inputs may be calculated based on other earlier user inputs—for example, in the case where a user has programmed a conditioning schedule.

Also, at step 421, the operating mode is determined. Operating modes may include cooling, heating, standby or other suitable modes. Some embodiments may allow the user to set the operating mode while in others the operating mode may be determined based on the sensor inputs and user inputs (e.g., the temperature in the conditioned space, the setpoint temperature). Similarly, in some embodiments the user may additionally be able to specify that the mode be determined automatically based on the sensor inputs and other user inputs. A "reset" mode (for simplicity not shown) may restart method 420 by returning it to "start" and potentially resulting in reinitialization of various variables to their initial start conditions (i.e., deleting memory of earlier loops of method 420).

At step 422, it is determined if the operating mode has changed in the current loop of method 420 as compared to the immediately preceding loop of method 420. Specifically, step 422 would determine "yes" if the present mode changed relative to the mode of the immediately preceding loop and "no" if the present mode did not change relative to the mode of the immediately preceding loop. For example, at step 422 method 420 would determine "yes" if the mode changed from "cooling" in the immediately preceding loop of method 420 to "heating" in the present loop of method 420. The first loop through method 420 (i.e., the initial loop) may be handled in any suitable way, for example, by assuming the value of the preceding loop to be "standby" as part of the initialization process for method 420.

If "yes" is determined at step 422, method 420 proceeds to step 423 where any control variables are set to initial values or other suitable values. Control variables may include quantities that change from loop to loop in method 420. For example, as discussed below, method 420 may utilize one or more integral control variables that accumulate over each loop of method 420 and such integral control variables may be reset at this step.

After step 423, or if "no" is determined at step 422, method 420 continues to step 424 where a leg of the flow diagram is selected based on the current mode. Three modes are shown in the embodiments of method 420 illustrated in the flow diagram: standby, cooling, and heating.

If it is determined at step 424 that the current mode is standby, method 420 proceeds to step 425 where the heating and cooling control valves are both closed and the recirculation pump is turned off. For the purposes of illustration it is assumed here (and in the discussion of steps 426-431) that a "cold" liquid supply system is connected to first supply ports 110 and 111 and a "hot" liquid supply system is connected to second supply ports 112 and 113 of control system 400 (FIG. 10). Thus, first control valve 130 may be referred to as the "cooling control valve", and second control valve 133 may be referred to as "heating control valve". Thus, with reference to control system 400, at step 425 first control valve 130 and second control valve 133 may be closed by sending appropriate signals via signal channels 411 and 412 respectively. Similarly, recirculation pump 120 may be turned off by providing an appropriate signal via signal channel 413. (The same signal channels may be used for control at other steps in method 420 as well.)

If it is determined at step 424 that the current mode is cooling, method 420 proceeds to step 426. At step 426 the heating control valve is closed. Closing the heating control valve prevents the flow of hot liquid into the control system and potentially mixing with the cold liquid. When the heating control valve is already closed at this step the method may proceed immediately to step 427. In some embodiments it may be assumed that the heating control valve is already closed under certain circumstances. For example it may be appropriate to assume so if the mode of the immediately preceding loop of method 420 was cooling since the heating control valve can only be un-closed in heating mode and it must have been closed for the preceding loop to continue past step 426.

If the heating control valve is not initially completely closed at this step, method 420 may pause until the heating control valve has completely closed or has had sufficient time to completely close in response to a suitable "close" control signal. In some embodiments the heating control valve provides a feedback signal as to the current valve position in which case method 420 may proceed to step 427 when such feedback signal indicates the heating control valve is completely closed. In some embodiments, the heating control valve is configured to receive a control signal specifying the valve position but does not provide direct feedback as to the actual valve position. The time to reach the valve position specified by the control signal may be non-trivial and thus method 420 may pause to allow sufficient time for the valve to close so as to avoid the possibility of both the cooling control valve and the heating control valve being open (and the potentially wasteful mixing of the hot and cold supply liquids). The amount of time to pause may be a fixed value, for example, the amount of time it takes to change the control valve position from completely open to completely closed. In some other embodiments, method 420 estimates the valve position based on the prior control signals to the valve, time, and known closing characteristics of the valve. For example, a control valve may require 90 seconds to go from completely open to completely closed. If the last heating control valve control signal was "10% open" and that signal was maintained for 2 minutes, method 420 can reasonably assume the heating control valve reached the 10% open position within that time. Accordingly, assuming the valve has a linear rate of closure, waiting 9 or more seconds (i.e., 10% of 90 seconds) after the "close" control signal was sent may be a sufficient amount of time to wait to conclude the heating control valve is completely closed (despite the lack of direct feedback on the valve position).

Step 426 is largely to improve efficiency by avoiding the mixing of hot and cold liquid. Some embodiments may proceed to step 427 before the heating control valve is completely closed (e.g., to improve overall system response time). Thus in some embodiments method 420 may proceed to step 427 immediately after sending the close signal to the heating control valve, after a predetermined amount of time (that may be less than the amount of time required to close the valve), or after the valve is reported or calculated to be substantially closed (e.g., 90% closed (10% open); 95% closed (5% open)).

After step 426, method 420 proceeds to step 427 where the target load input temperature is determined. The target load input temperature is the target temperature for the liquid entering the conditioning load. For example, with reference to control system 400, the target load input temperature is the temperature of the liquid flowing into the load, i.e., load input flow 193, at load input port 115. The target load input temperature may be determined based on the setpoint temperature (e.g., the desired ambient temperature in the conditioned space), the current temperature of the conditioned space (e.g., obtained from ambient sensor 182), elapsed time, information from prior loops of method 420, and the like. Any suitable control scheme may be used to determine the target load input temperature, for example, a proportional controller ("P controller"), a proportional-integral controller ("PI controller"), a proportional-integral-differential controller ("PID controller"), and the like may be used. In some embodiments a physics-based model of the conditioning system is used to determine the target load input temperature. In some embodiments an error signal used for control is calculated as the signed difference between the actual ambient temperature and the setpoint temperature.

In some embodiments the target load input temperature is constrained between the dew point temperature of the air plus some margin to prevent condensation, and the setpoint temperature. Advantageously if the load does not produce any condensate, costs associated with including a condensate pan or condensate drainage system are eliminated as well as the associated risks of water damage and mold. In some embodiments the setpoint temperature is constrained to be above the dew point temperature plus margin temperature. In some embodiments the margin is between 0 and 3° F. or ° C. The dew point temperature of the air may be provided by ambient sensor 182 or calculated based on measurements of ambient sensor 182 (e.g., from air temperature and relative humidity measurements). For example, ambient sensor 182 may include temperature and relative humidity sensors. Dew point can be calculated using a suitable formula from the measured temperature and relative humidity.

Having determined the target load input temperature, method 420 continues to step 428 where the cooling control valve position is determined and set. The recirculation pump may also be controlled. The cooling control valve may be set based on the load input temperature, the target load input temperature, elapsed time, information from prior loops of method 420, and the like. The load input temperature may be measured, for example, by sensor 150. Control schemes similar to those used for determining the target load input temperature at step 427 may be used to determine the cooling control valve position (e.g., P, PI, PID controllers; model based). An appropriate signal may be sent to the cooling control valve to set the determined valve position. In some embodiments an error signal used for control is calculated as the signed difference between the load input temperature and the target load input temperature. The range of the cooling control valve position may be, for example, from 0% open (i.e., fully closed) to 100% open (i.e., fully opened).

In some embodiments at step 428 the recirculation pump is turned on (or kept on). Such control methodology for the recirculation pump may be used, for example, if the recirculation pump is a fixed speed pump and the temperature of the cold supply liquid is unknown. In some other embodiments of method 420, the recirculation pump is controlled based on the inputs and the target load input temperature. For example, in some embodiments if the temperature of the cold supply liquid is above the target load input temperature the pump is turned/kept off, and if the temperature of the source cold liquid is below the target load input temperature the pump is turned on.

If it is determined at step 424 that the current mode is heating, method 420 proceeds to step 429. At step 429 the cooling control valve is closed. Considerations for closing the cooling valve are analogous to closing the heating control valve at step 426 while in the cooling mode.

After step 429, method 420 proceeds to step 430 where the target load input temperature is determined. The considerations and methods of determining the target load input temperature at step 430 are analogous to those at step 427 for cooling, however the lower bound temperature may not be critical since condensation on the load may not be a risk during heating, particularly if the setpoint temperature is well above the dew point. In one embodiment the control system is limited to setting the target load input temperature between the setpoint temperature and the nominal temperature of the hot liquid supply.

Having determined the target load input temperature, method 420 proceeds to step 431 where the heating control valve position is determined and set. The pump is also controlled. The considerations and methods for determining the heating control valve position and controlling the pump are largely analogous to those discussed in connection with step 428 for the cooling mode.

After completing step 425 in standby mode, step 428 in cooling mode, or step 431 in heating mode method 420 returns to step 421 and the process repeats.

It should be clear that method 420 may also be used to control a single-source control system such as controls system 101, 102, 103, and 104 (FIGS. 1-6). These control systems represent a special case where only "cooling" or "heating" mode is available at any given time.

In the case where a conditioning system, such as conditioning system 107 (FIG. 6), may, for example, be seasonally switched between cooling and heating, method 420 may be used but the cooling control valve and the heating control valve may be treated as the same valve (e.g., control valve 130 in FIG. 6) and thus the closing of the off-mode valve at steps 426 and 429 may be skipped. (Care may need to be taken to avoid allowing the mode to be set to the unavailable mode.)

It should be appreciated that other control methods may be implemented in control module 170 and the discussed embodiments of method 420 are examples. In other embodiments the steps of method 420 may be performed in different orders, some steps may be omitted, and other steps may be added.

Figure 12:
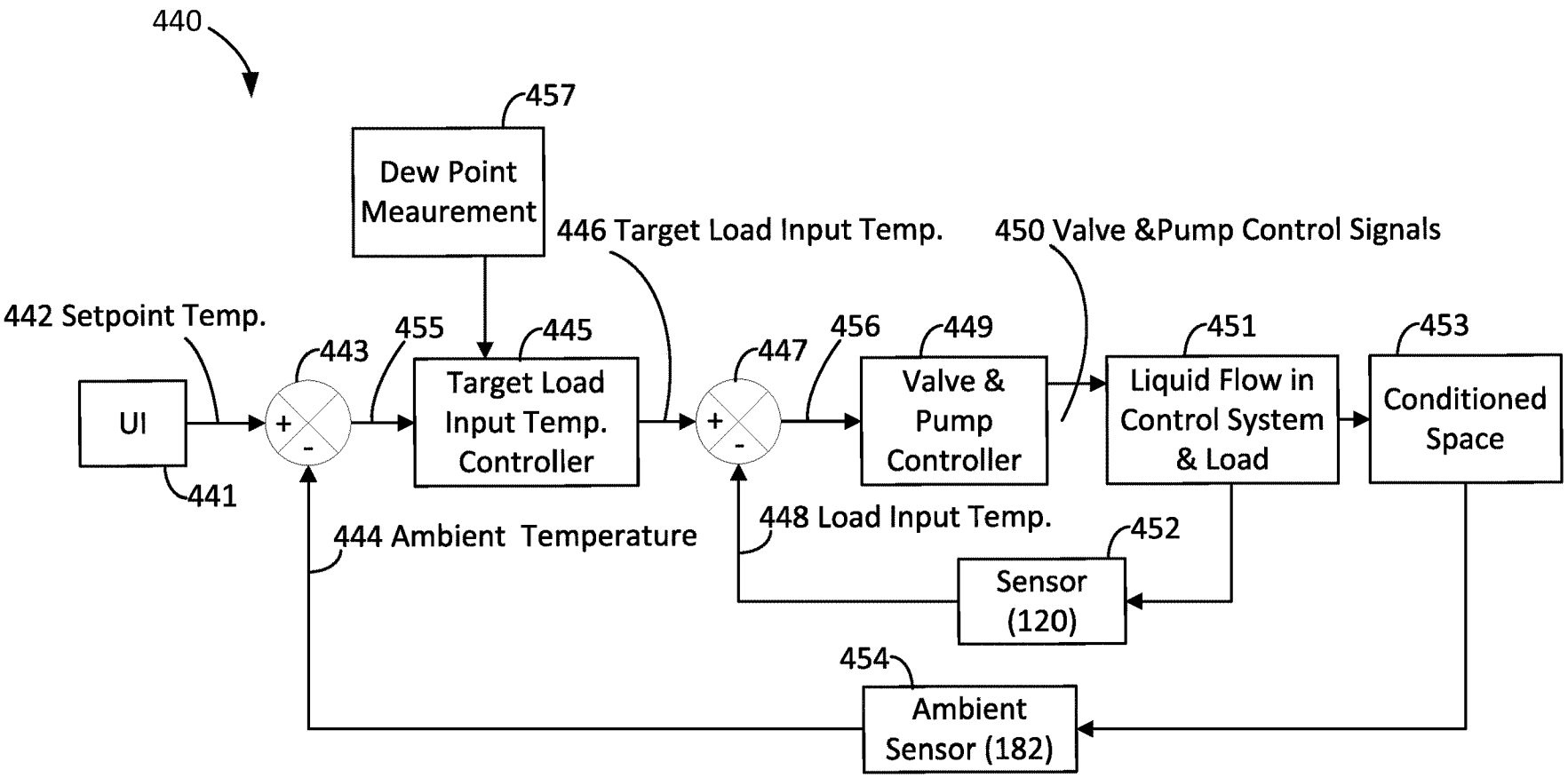
FIG. 12 is a flow diagram for operation of aspects of a control module utilizing a proportional controller according to some embodiments.

Turning now to FIG. 12, a flow diagram 440 for an embodiment which utilizes proportional controllers is illustrated. Flow diagram 440 can represent an embodiment of steps 421, 427 and 428 of method 420, an embodiment of steps 421, 430 and 431 of method 420, or as part of another control method or as part of control module 170. At box 441 a setpoint temperature 442 is obtained, for example, from a user interface 181 (discussed earlier; see e.g., FIG. 1). Combiner 443 subtracts the ambient temperature 444 in the conditioned space from the setpoint temperature 442 creating an error signal 455. Target load input temperature controller 445 scales and shifts error signal 455 to produce a target load input temperature 446. For example, the offset may be the setpoint temperature and the scaling factor may be determined by experiment or in another suitable way. In some embodiments a dew point temperature measurement 457 may also be used to determine the target load input temperature. Combiner 447 subtracts the measured load input temperature 448 from target load input temperature 446 to produce error signal 456. Valve and pump controller 449 produces a control valve control signal by scaling and shifting error signal 456. For example, assume the valve position is represented by a voltage between 2V and 10V, with 2V representing fully closed and 10V representing fully open, the offset may be 2V and the scaling factor may be determined by experiment. Assume in this embodiment that valve and pump controller simply turns on or leaves the recirculation pump on. The valve and pump control signals 450 affect the control valve and pump resulting in the liquid flow that occurs in the control system and the load (see box 451). This in turn affects the conditioned space (box 453). The feedback to combiner 443 and combiner 447 is facilitated by boxes 454 and 452, respectively. Box 452 represents a sensor that measures the temperature of the liquid flowing into the load such as sensor 120, and box 454 represents a sensor measuring a representative temperature of the conditioned space such as ambient sensor 182 (both discussed earlier; see e.g., FIG. 1).

Figure 13:
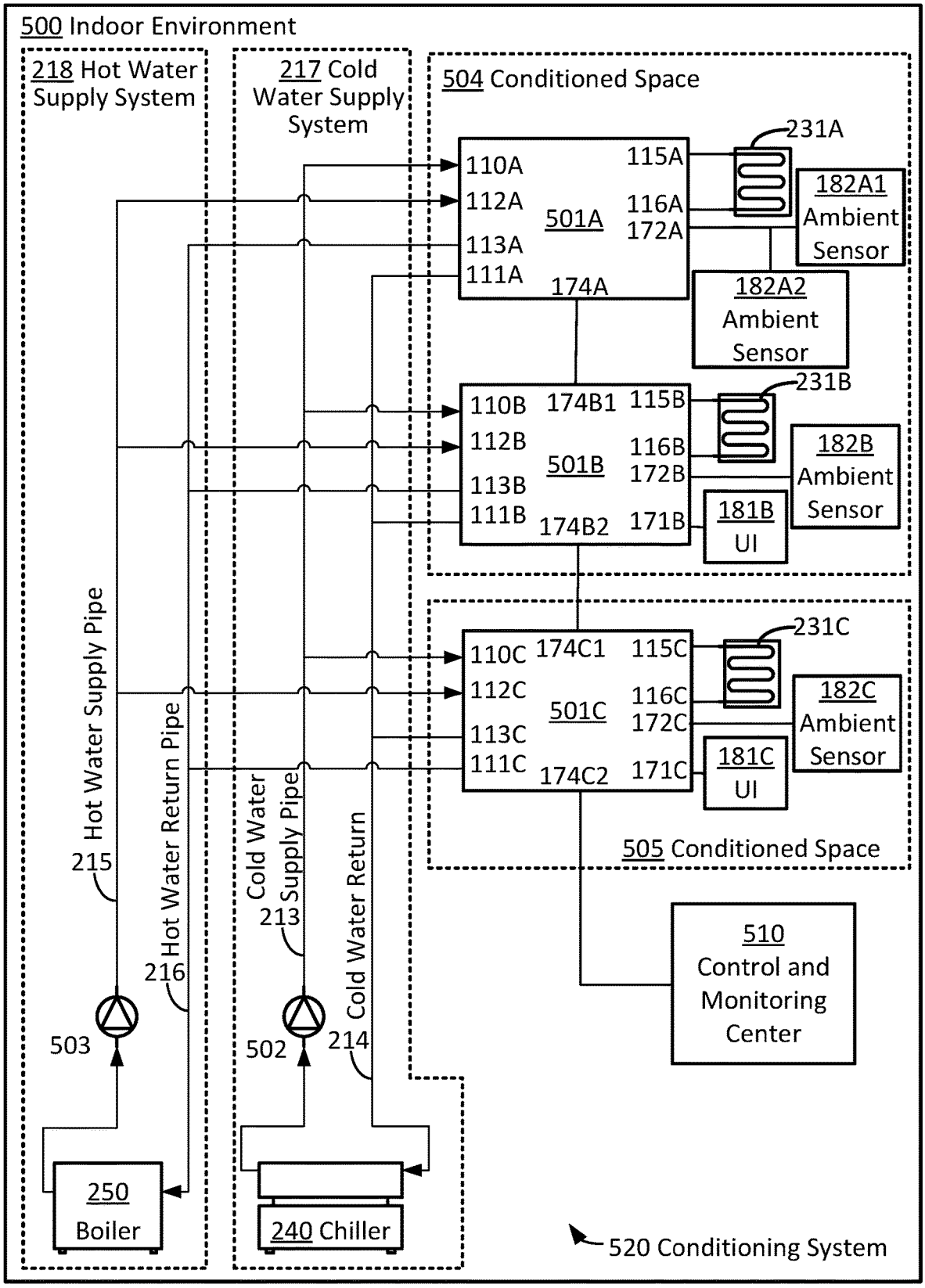
FIG. 13 is a diagram of an indoor environment with multiple conditioned spaces that are independently conditioned by a conditioning system according to some embodiments.
Figure 14:
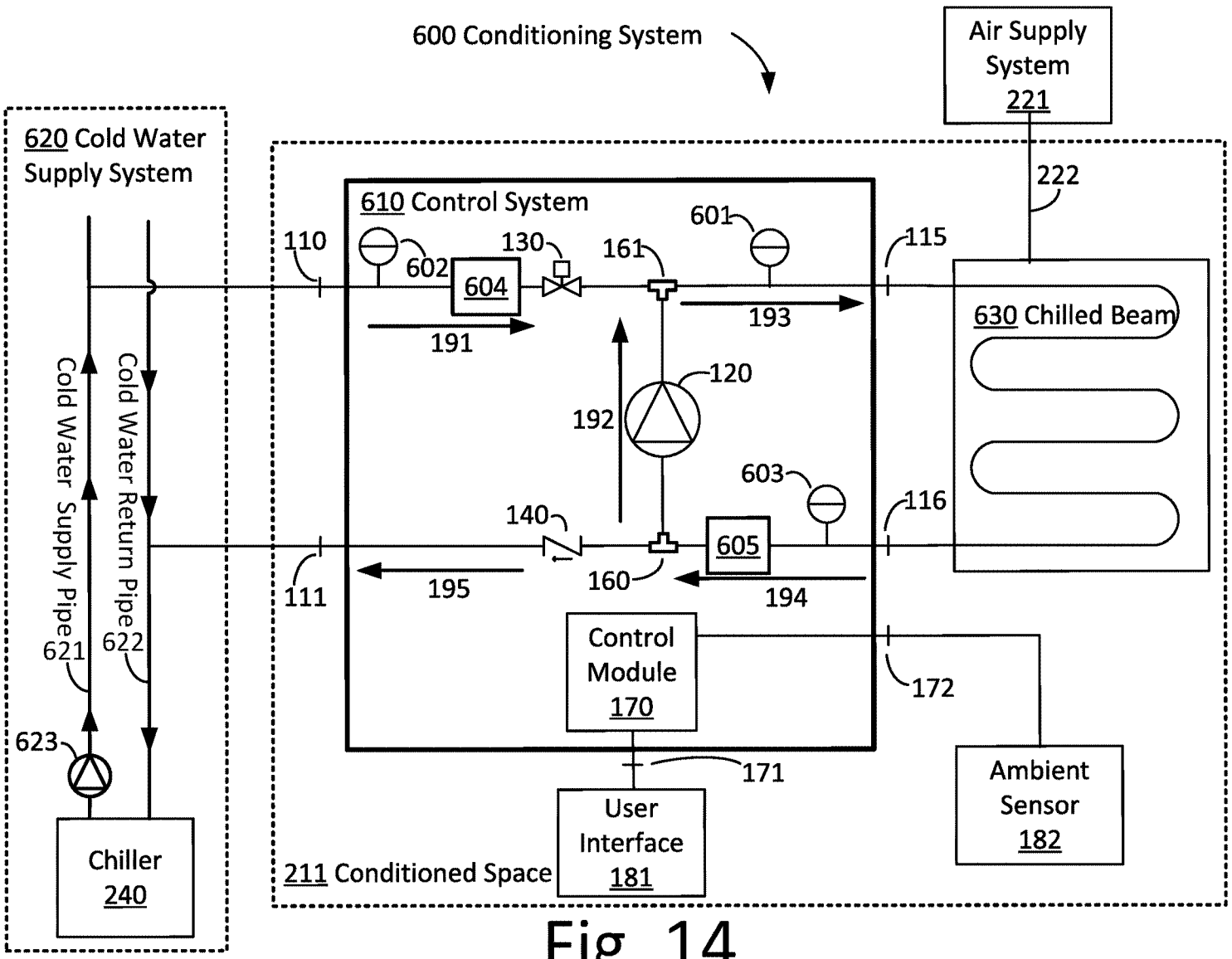
FIG. 14 is a conditioning system including a cold-water supply system, a control system and a chilled beam according to some embodiments.

Attention is now turned to FIG. 13 which shows an indoor environment 500 in a conditioning system 520 has been implemented according to some embodiments. In this example, indoor environment 500 has two conditioned spaces, namely, conditioned space 504 and conditioned space 505. Conditioning system 520 has been configured with a cold-water supply system 217 and a hot water supply system 218 having chiller 240 and boiler 250, respectively. Also shown in FIG. 13 are supply pumps 502 and 503 for the cold water and hot water supply systems 217 and 218, respectively. Supply pump 502 pumps cold water from chiller 240 through cold water supply pipe 213. This water returns to chiller 240 via the cold-water return line 214. Similarly, supply pump 503 pumps hot water from boiler 250 through hot water supply pipe 215. This water returns to boiler 250 via the hot water return line 216.

Connected to hot and cold-water supply systems 218 and 217 are control systems 501A, 501B, and 501C. The control systems in this embodiment are two-supply control systems such as control systems 271, and 400 discussed with reference to FIGS. 7 and 10. In this example embodiment, cold water supply system 217 is connected to the first supply input ports 110A, 110B, and 110C; and first supply return ports 111A, 111B, and 111C of the respective control systems. Hot water supply system 218 is connected to the second supply input ports 112A, 112B, and 112C; and second supply return ports 113A, 113B, and 113C of the respective control systems.

Connected to the control systems are conditioning loads 231A, 231B, and 231C, respectively via the respective load input ports 115A, 115B, and 115C and the respective load return ports 116A, 116B, and 116C.

Controls systems 501A and 501B and their respective loads are in conditioned space 504. Control system 501C and its load 231C is in conditioned space 505. Each control system may be installed along with its respective load in the ceiling or wall of the associated conditioned space, hung from the ceiling, or placed in another suitable location in the conditioned space. Conditioned space 504 may, for example, be a relatively large room requiring two loads while conditioned space 505 may be relatively smaller requiring only a single load to meet the heating and cooling needs of the room.

In this embodiment, the control systems are daisy chained to one another via their data ports. As illustrated, control systems 501B and 501C both have data ports with two connectors to facilitate wired communication. Specifically, data port 174A of control system 501A is connected to data port 174B1 of control system 501B; data port 174B2 of control system 501B is connected to data port 174C1 of control system 501C; and finally data port 174C2 of control system 501B is connected to a control and monitoring center 510. Center 510 may be a computer system that allows for controlling and monitoring all aspects of conditioning system 520. Center 510 may be local to indoor environment 500 or may be connected to via the internet or other network. Any suitable data may be communicated between each of the control systems and center 510. In some embodiments, center 510, for example, logs the performance of the control systems; this data may be analyzed and used to update control parameters such as control coefficients used by the control modules.

In conditioned space 504 a user interface 181B is connected to control system 501B via UI port 171B. User interface commands such as setting the setpoint temperature or the mode of operation (e.g., cooling, heating, standby) may be communicated to both control systems 501A and 501B so that these control systems are always working together to condition space 504. The settings entered through UI 181B may be communicated from control system 501B to control system 501A via the connection between data ports 174B1 and 174A.

Control system 501A has ambient sensors 182A1 and 182A2 connected via ambient sensor port 172A. Control system 501B has ambient sensor 182B connected via ambient sensor port 172B. In some embodiments, ambient sensor 182A1 is positioned on, in, or proximal to load 231A so as to provide accurate dew point temperature estimates at load 231A. Similarly, ambient sensor 182B may be positioned on, in, or proximal to load 231B, again with the goal of providing accurate dew point temperature measurements at load 231B. On the other hand, ambient sensor 182A2 may be used to measure the ambient temperature used by both the control modules of control systems 501A and 501B. In this case ambient sensor 182A2 may be positioned at a suitable location in conditioned space 504. Example locations for sensor 182A2 include on a wall, table, at a location unlikely to receive direct sunlight. In some embodiments, ambient sensor 182A2 has a wireless connection to port 172A to enable the sensor to be positioned with a greater amount of flexibility. The ambient temperature measured by ambient sensor 182A2 may be communicated from control system 501A to control system 501B via the connection of data ports 174A and 174B2 allowing both systems to utilize the same ambient temperature measurement for control.

Conditioned space 505 may be conditioned by control system 501C and load 231C independent from the conditioning of conditioned space 504. UI 181C, connected to control system 501C via UI port 171C, may allow the user to configure control system 501C, for example, by setting the setpoint temperature. Ambient sensor 182C is connected to control system 501C via ambient sensor port 172C.

Experiments were conducted with a conditioning system to verify operational aspects of some embodiments. Some example results are presented with reference to FIG. 14 which shows a conditioning system 600 with a control system 610, cold water supply system 620, and chilled beam 630. For simplicity a single supply system connected to a cold-water supply is shown. For the experiments, a hot water supply system was also connected to a second set of supply ports (not shown) on control system 610. Control system 610 was instrumented with temperature sensors 601, 602, and 603; and flow meters 604 and 605. (Other components are as described elsewhere by the same reference number.) Control system 610 was connected to cold water supply system 620 via ports 110 and 111. Cold water supply system 620 included a chiller 240, a pump 623, and cold-water supply pipe 621 and cold water return pipe 622. Chiller 240 was configured to provide cold water at about 45° F.

Temperature sensor 601 measured the temperature of the water entering the load 231 through load input port 115. Temperature sensor 602 measured the temperature of the water entering supply input port 110. Temperature sensor 603 measured the temperature of the water entering load return port 116. Flow meter 604 measured supply input flow 191 coming through supply input port 110. Flow meter 605 measured load return flow 194.

Control system 610 was run and an actual test result is illustrated. With recirculation pump 120 running ambient sensor 182 measured the temperature and relative humidity of conditioned space 211 as 73° F. and 50%, respectively. This corresponds to a dew point of about 53.3° F. Control valve 130 was partially open resulting in a measured supply input flow 191 of 0.4 gallons per minute (GPM) at flow meter 604. The temperature of the supply water at temperature sensor 602 was measured as 44.9° F. (close to the nominal 45° F.). At the same time flow meter 605 measured load return flow 194 as 1.27 GPM. The temperature of the water entering the chilled beam was measured by temperature sensor 601 as 57.2° F. (3.9° F. above the dew point) while the temperature of the water existing the beam was measured by temperature sensor 603 as 63.5° F. The temperature change from the input to the return port of the chilled beam is 6.3° F., which is within the typical range for a variety of commercially available chilled beams).

These measurements imply a recirculation flow 192 of 0.87 GPM. These particular measurements were reasonably self-consistent. For example, the temperature of load input flow 193 can be estimated in two ways—the direct measurement from temperature sensor 601 (57.2° F.) and by a weighted average of the temperatures and flow rates of supply input flow 191 and recirculation flow 192. Assuming the temperature of recirculation flow 192 is the same as load return flow 194 we calculate a load input flow temperature of 57.6° F. (i.e., $((44.9\times0.4)+(63.5\times0.87))/(0.4+0.87)$).

An energy balance around control system 610 should indicate that the energy input from the water supply 620 should equal energy output to the chilled beam 630. The energy, Q, in Btu/hr, can be expressed as $Q=500\times F\times\Delta T$, where F is the flow rate in gallons per minute, and $\Delta T$ is the change in temperature from the return to the input in degrees Fahrenheit. (The constant 500 relates to the choice of units and has the unit Btu minute per gallon hour Fahrenheit.) We calculate the energy from the supply system as 3,720 Btu/hr (i.e., $500\times0.4\times(63.5-44.9)$) and the energy to the chilled beam as 4,000 Btu/hr (i.e., $500\times1.27\times(63.5-57.2)$). These numbers are equivalent within the measurement error of our sensors. (Note, the energy exchange in the control system is negligible for our purposes compared to that in the chilled beam.)

Having thus described several aspects of at least one embodiment of this invention, it is to be appreciated that various alterations, modifications, and improvements will readily occur to those skilled in the art. Such alterations, modifications, and improvements are intended to be part of this disclosure and are intended to be within the spirit and scope of the invention. Accordingly, the foregoing description and drawings are by way of example only.

It should be appreciated that the connections between the hydraulic components shown in the drawings and described with reference to embodiments of control systems, liquid supply systems, conditioning systems, and the like may be achieved by any suitable pipe, hose, tube, conduit, or other mechanism for conveying liquid under pressure. Where such connections have been described as a specific hydraulic conveyance (e.g., liquid supply "pipe" 203, FIG. 4) it should be appreciated that other embodiments may use hose, tube, conduit, or any other suitable hydraulic conveyance.

It should be appreciated that all mechanical and end electrical equipment will have functional limitations. Generally, the ideal behavior has been described so as to not unnecessarily distract from the general operation and description of the embodiments. Those of skill in the art will recognize and appreciate the need to consider both ideal and non-ideal behavior in designing specific embodiments just as with any electrical or mechanical device.

It should also be appreciated that in describing the operation of valves such as control valves 130 and 131 variations of "close" and "open" (e.g., closed, closing, opened, opening) generally refer to the change in the control valve's resistance to flow relative to its current position and do not mean "completely closed" (whereby flow is prevent) or "completely open" (allowing maximum flow) unless it is clear from the context that that is the intended meaning.

It should also be appreciated that the descriptions of components having the same name or same reference number appear in multiple drawings (e.g., control valve 130, first control valve 130, second control valve 133) so as to avoid having to describe the common aspects of a component multiple times. It should be clear to those of skill in the art whether such descriptions made with reference to one embodiment are applicable to another embodiment.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the invention may be embodied as a computer readable medium (or multiple computer readable media) (e.g., a computer memory, one or more floppy discs, compact discs, optical discs, magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

In this respect, it should be appreciated that one implementation of the above-described embodiments comprises at least one computer-readable medium encoded with a computer program (e.g., a plurality of instructions), which, when executed on a processor, performs some or all of the above-discussed functions of these embodiments. As used herein, the term "computer-readable medium" encompasses only a computer-readable medium that can be considered to be a machine or a manufacture (i.e., article of manufacture). A computer-readable medium may be, for example, a tangible medium on which computer-readable information may be encoded or stored, a storage medium on which computer-readable information may be encoded or stored, and/or a non-transitory medium on which computer-readable information may be encoded or stored. Other non-exhaustive examples of computer-readable media include a computer memory (e.g., a ROM, a RAM, a flash memory, or other type of computer memory), a magnetic disc or tape, an optical disc, and/or other types of computer-readable media that can be considered to be a machine or a manufacture.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

For the purposes of describing and defining the present disclosure, it is noted that terms of degree (e.g., "substantially," "slightly," "about," "comparable," etc.) may be utilized herein to represent the inherent degree of uncertainty that may be attributed to any quantitative comparison, value, measurement, or other representation. Such terms of degree may also be utilized herein to represent the degree by which a quantitative representation may vary from a stated reference (e.g., about 10% or less) without resulting in a change in the basic function of the subject matter at issue. Unless otherwise stated herein, any numerical values appearing in this specification may be modified by a term of degree thereby reflecting their intrinsic uncertainty.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A control system comprising:

a supply input port;

a load return port;

a recirculation pump for pumping liquid from a pump input port to a pump output port, the pump input port connected to receive a first portion of liquid flowing from the load return port;

a junction configured to combine liquid flowing from the pump output port with liquid flowing from the supply input port;

a load input port configured to receive such combined liquid from the junction;

a supply return port connected to receive a remaining portion of the liquid flowing from the load return port;

an actuator to vary a flow rate of liquid between the supply input port and the supply return port;

a temperature sensor; and a control module to control the actuator based at least in part on a liquid temperature measured by the temperature sensor, wherein the liquid temperature measured by the temperature sensor is a load input temperature of the combined liquid, the control module is configured to determine a target liquid temperature for the load input temperature based at least in part on a setpoint temperature and an ambient temperature in a conditioned space, and p1 the control module, if operating in a cooling mode, is configured to turn off the recirculation pump if liquid flowing from the supply input port is higher than the target liquid temperature.

2. The control system of claim 1, wherein the recirculation pump is a fixed speed pump.

3. The control system of claim 1, wherein the control module is configured to receive an ambient temperature in a conditioned space and a setpoint temperature, and to additionally control the actuator based on the setpoint temperature and the ambient temperature.

4. The control system of claim 3, wherein the liquid temperature measured by the temperature sensor is a load input temperature of the combined liquid, and the control module is configured to determine a target liquid temperature for the load input temperature based at least in part on the setpoint temperature and the ambient temperature.

5. The control system of claim 1, wherein the junction is a second junction, the control system further comprising:

a first junction to split flow from the load return port into the first portion and the remaining portion; and a check valve connected between the supply return port and the first junction, the check valve oriented to allow liquid to flow through the check valve to the supply return port, wherein the actuator is connected between the supply input port and the second junction.

6. The control system of claim 1, wherein the junction is a second junction, the control system further comprising:

a first junction to split flow from the load return port into the first portion and the remaining portion; and a check valve connected between the supply input port and the second junction, the check valve oriented to allow liquid to flow from the supply input port through the check valve, wherein the actuator is connected between the supply return port and the first junction.

7. The control system of claim 1 wherein the load input port and load return port are operably connected to a conditioning load comprising a coil.

8. The control system of claim 7, wherein the conditioning load comprises a chilled beam.

9. The control system of claim 7, wherein the conditioning load comprises a fan coil unit.

10. The control system of claim 1, wherein the recirculation pump is a variable-speed pump.

11. The control system of claim 1, wherein the actuator comprises a control valve.

12. A control system comprising:

a supply input port;

a load return port;

a recirculation pump for pumping liquid from a pump input port to a pump output port, the pump input port connected to receive a first portion of liquid flowing from the load return port;

a junction configured to combine liquid flowing from the pump output port with liquid flowing from the supply input port;

a load input port configured to receive such combined liquid from the junction;

a supply return port connected to receive a remaining portion of the liquid flowing from the load return port;

an actuator to vary a flow rate of liquid between the supply input port and the supply return port;

a temperature sensor; and a control module to control the actuator based at least in part on a liquid temperature measured by the temperature sensor, wherein the control module is configured to receive an ambient temperature in a conditioned space and a setpoint temperature, and to additionally control the actuator based on the setpoint temperature and the ambient temperature, the liquid temperature measured by the temperature sensor is a load input temperature of the combined liquid, the control module is configured to determine a target liquid temperature for the load input temperature based at least in part on the setpoint temperature and the ambient temperature, and the temperature sensor is a first temperature sensor, and the control system further comprises a second temperature sensor to measure a load return temperature of the liquid flowing from the load return port.

13. The control system of claim 12, wherein the control module is further configured to determine a change in liquid temperature across the load input port and the load return port based on the load input temperature and the load return temperature.

14. The control system of claim 12, wherein the control module is further configured to:

receive an indication of moisture content of air in the conditioned space, determine a dew point from the indication of moisture content and the ambient temperature, and determine the target liquid temperature based on the dew point, the setpoint temperature, and the ambient temperature.

15. The control system of claim 12, wherein the actuator comprises a control valve.

16. A control system, comprising:

a first supply input port;

a load return port;

a first junction to split flow from the load return port into a first portion and a second portion;

a recirculation pump for pumping liquid from a pump input port to a pump output port, the pump input port configured to receive the first portion from the first junction;

a first supply return port configured to receive the second portion;

a second junction to combine flow from the first supply input port and the pump output port;

a load input port configured to receive such combined flow from the second junction;

a first actuator to vary a first flow rate of liquid between the first supply input port and the supply return port;

a temperature sensor; and a control module to control the first actuator and the pump based at least in part on a liquid temperature measured by the temperature sensor;

a second supply input port;

a second supply return port; and a second actuator connected between the second supply return port and the first junction to vary a second flow rate of liquid between the second supply input port and the second supply return port.

17. The control system of claim 16, wherein the actuator comprises a control valve.

18. A control system, comprising:

a supply input port;

a load return port;

a first junction to split flow from the load return port into a first portion and a second portion;

a recirculation pump for pumping liquid from a pump input port to a pump output port, the pump input port configured to receive the first portion from the first junction;

a supply return port configured to receive the second portion;

a second junction to combine flow from the supply input port and the pump output port;

a load input port configured to receive such combined flow from the second junction;

an actuator to vary a flow rate of liquid between the supply input port and the supply return port;

a temperature sensor; and a control module to control the actuator and the pump based at least in part on a liquid temperature measured by the temperature sensor, wherein the control module is further configured to (i) receive an ambient temperature in a conditioned space and a setpoint temperature, (ii) determine a target liquid temperature based at least in part on the setpoint temperature and the ambient temperature, (iii) control the actuator based on the target liquid temperature and the liquid temperature measured by the temperature sensor, and (iv) control the recirculation pump based at least in part on an operating mode.

19. The control system of claim 18, wherein the control module, if the operating mode is a cooling mode, further determines the target liquid temperature based on a dew point in the conditioned space.

20. The control system of claim 19, wherein the control module, if the operating mode is a cooling mode, prevents the target liquid temperature from being below the dew point plus a margin.

21. The control system of claim 20, wherein the margin is a positive number.

22. The control system of claim 18, wherein the control module, if the operating mode is a cooling mode, is configured to turn off the recirculation pump if liquid flowing from the supply input port is higher in temperature than the target liquid temperature.

23. The control system of claim 22, wherein the recirculation pump is a fixed speed pump, and the control module, if the operating mode is a cooling mode, is configured to turn on the recirculation pump if liquid flowing from the supply input port is lower in temperature than the target liquid temperature.

24. The control system of claim 18, wherein the temperature sensor is a first temperature sensor, and the control module, if the operating mode is a cooling mode, is configured to turn off the recirculation pump if a supply liquid temperature of liquid flowing from the supply input port is higher than the target liquid temperature, the control system further comprising a second temperature sensor to measure the supply liquid temperature.

25. The control system of claim 18, wherein the actuator comprises a control valve.

* * * * *